US010927547B2

(12) United States Patent
MacDonald

(10) Patent No.: US 10,927,547 B2
(45) **Date of Patent: *Feb. 23, 2021**

(54) WALL BLOCKS, VENEER PANELS FOR WALL BLOCKS AND METHOD OF CONSTRUCTING WALLS

(71) Applicant: Keystone Retaining Wall Systems LLC, West Chester, OH (US)

(72) Inventor: Robert A. MacDonald, Plymouth, MN (US)

(73) Assignee: Keystone Retaining Wall Systems LLC, West Chester, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/048,930

(22) Filed: Jul. 30, 2018

(65) Prior Publication Data

US 2018/0334805 A1 Nov. 22, 2018

Related U.S. Application Data

(63) Continuation of application No. 14/944,663, filed on Nov. 18, 2015, now abandoned, which is a (Continued)

(51) Int. Cl.
*E04B 2/18* (2006.01)
*E04B 2/20* (2006.01)
(Continued)

(52) U.S. Cl.
CPC ..... *E04C 1/39* (2013.01); *E02D 29/025* (2013.01); *E04B 1/04* (2013.01); *E04B 2/14* (2013.01);
(Continued)

(58) Field of Classification Search
CPC ... E04C 1/39; E04C 1/395; E04C 1/00; E04C 2/38; E04C 2/46; E02D 29/025;
(Continued)

(56) References Cited

U.S. PATENT DOCUMENTS 894,122 A 7/1908 Dougherty
1,115,542 A 11/1914 Hudson
(Continued)

FOREIGN PATENT DOCUMENTS

CA 2 526 876 A1 2/2006
WO WO 2004/076759 A2 9/2004
(Continued)

OTHER PUBLICATIONS

Oct. 5, 2005 Notification of Transmittal of the International Search Report and the Written Opinion of the International Searching Authority, or the Declaration in PCT/US2005/014769 (12 pages).
(Continued)

*Primary Examiner* — Phi D A
(74) *Attorney, Agent, or Firm* — Dorsey & Whitney LLP

(57) ABSTRACT

Wall blocks, veneers, veneer connectors, walls, and methods of constructing walls are provided. More particularly, the invention relates to constructing walls in which a veneer panel is attached to a wall block with a connector and in which the front faces of the veneers have a desirable texture.

20 Claims, 34 Drawing Sheets

Related U.S. Application Data continuation of application No. 14/172,157, filed on Feb. 4, 2014, now abandoned, which is a continuation of application No. 12/893,308, filed on Sep. 29, 2010, now Pat. No. 8,656,678.

(60) Provisional application No. 61/253,987, filed on Oct. 22, 2009, provisional application No. 61/246,805, filed on Sep. 29, 2009.

(51) Int. Cl.

| | |
|---|---|
| ***E02D 29/02*** | (2006.01) |
| ***E04C 2/38*** | (2006.01) |
| ***E04C 1/39*** | (2006.01) |
| ***E04C 1/00*** | (2006.01) |
| ***E04B 2/00*** | (2006.01) |
| ***E04B 1/04*** | (2006.01) |
| ***E04B 2/14*** | (2006.01) |
| ***E04F 13/08*** | (2006.01) |
| *E04B 2/02* | (2006.01) |

(52) U.S. Cl.

CPC ..... *E04C 1/00* (2013.01); *E04C 1/395* (2013.01); *E04C 2/38* (2013.01); *E04C 2/46* (2013.01); *E04F 13/0801* (2013.01); *E04B 2/18* (2013.01); *E04B 2/20* (2013.01); *E04B 2002/0245* (2013.01); *E04B 2002/0256* (2013.01); *E04B 2002/0269* (2013.01); *Y10T 403/75* (2015.01)

(58) Field of Classification Search

CPC ..... E02D 29/0241; E04B 1/04; E04B 2/14; E04B 2002/0269; E04B 2002/0245; E04B 2002/0256; E04B 2/18; E04B 2/20; E04B 2/08; E04F 13/0801; Y10T 403/75

See application file for complete search history.

(56) References Cited

U.S. PATENT DOCUMENTS

| | | | | |
|---|---|---|---|---|
| 1,462,374 | A | | 7/1923 | Metz |
| 1,962,906 | A | | 6/1934 | Mueller |
| 2,121,037 | A | | 6/1938 | Kotrbaty |
| 2,316,819 | A | | 4/1943 | Tedrow |
| 2,918,814 | A | | 12/1959 | Farina |
| 3,102,367 | A | | 9/1963 | Pedersen et al. |
| 3,555,757 | A | | 1/1971 | Volent |
| 3,660,954 | A | | 5/1972 | Logan |
| 3,686,873 | A | | 8/1972 | Vidal |
| 3,815,370 | A | | 6/1974 | Lennox |
| 3,895,469 | A | | 7/1975 | Kapitan |
| 3,950,908 | A | | 4/1976 | Van Eyk |
| 4,229,920 | A | | 10/1980 | Lount |
| 4,238,105 | A | | 12/1980 | West |
| 4,263,765 | A | | 4/1981 | Maloney |
| 4,449,857 | A | | 5/1984 | Davis |
| 4,454,693 | A | | 6/1984 | Price |
| 4,454,699 | A | | 6/1984 | Strobl |
| 4,470,728 | A | | 9/1984 | Broadbent |
| 4,545,703 | A | | 10/1985 | Boynton |
| 4,564,316 | A | | 1/1986 | Hunziker |
| 4,593,513 | A | | 6/1986 | Stratton |
| 4,661,023 | A | | 4/1987 | Hilfiker |
| 4,684,287 | A | | 8/1987 | Wojciechowski |
| 4,703,602 | A | | 11/1987 | Pardo |
| 4,706,429 | A | | 11/1987 | Young |
| 4,884,382 | A | | 12/1989 | Horobin |
| 4,884,921 | A | | 12/1989 | Smith |
| 4,885,888 | A | | 12/1989 | Young |
| 4,887,691 | A | | 12/1989 | Rotondo |
| 4,894,969 | A | | 1/1990 | Horobin |
| 4,913,594 | A | | 4/1990 | Sigourney |
| 4,967,532 | A | | 11/1990 | Castle et al. |
| 4,993,879 | A | | 2/1991 | Hilfiker |
| 5,350,256 | A | | 9/1994 | Hammer |
| 5,428,933 | A | | 7/1995 | Philippe |
| 5,459,970 | A | * | 10/1995 | Kim ..... E04B 1/165 52/379 |
| 5,524,405 | A | | 6/1996 | Byrd |
| 5,538,363 | A | | 6/1996 | Eastwood |
| 5,551,810 | A | | 9/1996 | Franceski et al. |
| 5,567,089 | A | | 10/1996 | Akamine |
| 5,588,786 | A | | 12/1996 | House et al. |
| 5,611,183 | A | * | 3/1997 | Kim ..... E04B 2/845 52/357 |
| 5,623,797 | A | | 4/1997 | Gravier et al. |
| 5,704,183 | A | | 1/1998 | Woolford |
| 5,735,643 | A | | 4/1998 | Castonguay et al. |
| 5,788,423 | A | | 8/1998 | Perkins |
| 5,823,717 | A | | 10/1998 | Bastick et al. |
| 5,845,448 | A | | 12/1998 | Potvin |
| D404,146 | S | | 1/1999 | Perkins |
| 5,878,545 | A | | 3/1999 | Gebhart |
| 5,930,964 | A | | 8/1999 | Boehning |
| 5,934,035 | A | | 8/1999 | Rasmussen et al. |
| 6,024,516 | A | | 2/2000 | Taylor et al. |
| 6,062,772 | A | | 5/2000 | Perkins |
| 6,070,380 | A | | 6/2000 | Meilleur |
| 6,141,933 | A | | 11/2000 | McClinton |
| 6,148,576 | A | | 11/2000 | Janopaul, Jr. |
| 6,176,049 | B1 | | 1/2001 | Crant et al. |
| 6,230,462 | B1 | | 5/2001 | Beliveau |
| 6,247,280 | B1 | | 6/2001 | Grinshpun et al. |
| 6,314,697 | B1 | | 11/2001 | Moore, Jr. |
| 6,318,040 | B1 | | 11/2001 | Moore, Jr. |
| 6,321,497 | B1 | | 11/2001 | Cormier |
| 6,363,683 | B1 | | 4/2002 | Moore, Jr. |
| 6,374,556 | B2 | | 4/2002 | Crant et al. |
| 6,401,419 | B1 | | 6/2002 | Beliveau |
| 6,443,666 | B1 | | 9/2002 | Smith |
| 6,523,312 | B2 | | 2/2003 | Budge |
| 6,526,713 | B2 | | 3/2003 | Moore, Jr. |
| 6,536,172 | B1 | | 3/2003 | Amend |
| 6,578,338 | B1 | | 6/2003 | Nanayakkara |
| 6,607,683 | B1 | | 8/2003 | Harrington |
| 6,668,502 | B2 | | 12/2003 | Beliveau |
| 6,668,503 | B2 | | 12/2003 | Beliveau |
| 6,708,459 | B2 | | 3/2004 | Bodnar |
| 6,758,636 | B2 | | 7/2004 | Rainey et al. |
| 6,792,729 | B2 | | 9/2004 | Beliveau |
| 6,820,384 | B1 | | 11/2004 | Pfeiffer |
| 6,827,527 | B2 | | 12/2004 | Conkel et al. |
| 6,848,228 | B1 | | 2/2005 | Williams |
| 6,978,581 | B1 | | 12/2005 | Spakousky |
| 6,990,774 | B2 | | 1/2006 | Clapp |
| 7,032,357 | B2 | | 4/2006 | Cooper et al. |
| 7,082,731 | B2 | | 8/2006 | Patz et al. |
| 7,082,732 | B2 | | 8/2006 | Titishov |
| 7,121,051 | B2 | | 10/2006 | Hunsaker |
| 7,165,374 | B2 | | 1/2007 | Chanesian |
| 7,165,916 | B2 | | 1/2007 | Nanayakkara |
| 7,235,204 | B2 | | 6/2007 | Harrington |
| 7,409,801 | B2 | * | 8/2008 | Pfeiffer ..... E04B 2/8635 52/426 |
| 7,415,805 | B2 | | 8/2008 | Nickerson |
| 7,669,375 | B2 | | 3/2010 | Everett |
| 7,730,688 | B2 | | 6/2010 | Pfeiffer |
| 7,827,752 | B2 | | 11/2010 | Scherrer |
| 8,099,918 | B2 | * | 1/2012 | Marsh ..... E02D 27/02 52/253 |
| 8,656,678 | B2 | | 2/2014 | MacDonald |
| 8,800,227 | B2 | | 8/2014 | LeBlang |
| 8,959,859 | B2 | * | 2/2015 | Haan ..... E05B 65/006 52/309.1 |
| 2001/0027630 | A1 | | 10/2001 | Moore, Jr. et al. |
| 2002/0001509 | A1 | | 1/2002 | Hong |
| 2002/0078649 | A1 | | 6/2002 | Clapp |
| 2003/0074856 | A1 | | 4/2003 | Hammer |
| 2005/0204679 | A1 | | 9/2005 | Pfeiffer |
| 2005/0204699 | A1 | | 9/2005 | Rue |
| 2005/0242468 | A1 | | 11/2005 | MacDonald et al. |

(56) References Cited

U.S. PATENT DOCUMENTS

| | | | |
|---|---|---|---|
| 2005/0252144 | A1 | 11/2005 | MacDonald et al. |
| 2005/0252145 | A1 | 11/2005 | MacDonald et al. |
| 2005/0252146 | A1 | 11/2005 | MacDonald et al. |
| 2005/0252147 | A1 | 11/2005 | MacDonald et al. |
| 2006/0197257 | A1 | 9/2006 | Burt et al. |
| 2006/0260240 | A1 | 11/2006 | Patz et al. |
| 2006/0263575 | A1 | 11/2006 | Ritchie |
| 2007/0044426 | A1 | 3/2007 | Deans |
| 2008/0057801 | A1 | 3/2008 | Duffy |
| 2008/0289282 | A1 | 11/2008 | MacDonald |
| 2008/0313988 | A1 | 12/2008 | MacDonald |
| 2009/0013638 | A1 | 1/2009 | Clarno |
| 2009/0090077 | A1 | 4/2009 | Rodebaugh et al. |
| 2009/0151281 | A1 | 6/2009 | MacDonald et al. |

FOREIGN PATENT DOCUMENTS

| | | | |
|---|---|---|---|
| WO | WO 2005/108683 | A1 | 11/2005 |
| WO | WO 2007/069027 | A2 | 6/2007 |
| WO | WO 2008/092237 | A1 | 8/2008 |

OTHER PUBLICATIONS

Mar. 3, 2011 PCT International Search Report and Written Opinion in corresponding International Application No. PCT/US2010/050670 (13 pages).

* cited by examiner

WALL BLOCKS, VENEER PANELS FOR WALL BLOCKS AND METHOD OF CONSTRUCTING WALLS

This application is a continuation of U.S. Ser. No. 14/944,663, filed Nov. 18, 2015, which is a continuation of U.S. Ser. No. 14/172,157, filed Feb. 4, 2014, now abandoned, which is a continuation of U.S. Ser. No. 12/893,308, filed Sep. 29, 2010, now U.S. Pat. No. 8,656,678, issued Feb. 25, 2014, which claims the benefit of U.S. Provisional Application No. 61/246,805, filed Sep. 29, 2009, entitled "Wall Blocks, Veneer Panels for Wall Blocks and Method of Constructing Walls", and U.S. Provisional Application No. 61/253,987, filed Oct. 22, 2009, entitled "Wall Blocks, Veneer Panels for Wall Blocks and Method of Constructing Walls" the contents of each of which are hereby incorporated by reference herein.

FIELD OF THE INVENTION

The present invention relates to wall blocks, veneer panels and walls made from such blocks. In particular, this invention relates to wall blocks having a connection system that attaches veneer panels to wall blocks and a pinning system that connects courses of blocks with veneer panels to adjacent courses of blocks with veneer panels to form walls that are straight, curvilinear, retaining or freestanding or that have 90 degree corners. Additionally, columns, pilasters and parapets may be constructed with the blocks and veneer panels of the present invention and optionally vertical and horizontal reinforcement members may be utilized in building any structure with the present invention.

BACKGROUND OF THE INVENTION

Retaining walls are used in various landscaping projects and are available in a wide variety of styles. Numerous methods and materials exist for the construction of retaining walls. Such methods include the use of natural stone, poured concrete, precast panels, masonry, and landscape timbers or railroad ties.

A widely accepted method of construction of such walls is to dry stack concrete wall units, or blocks. These blocks are popular because they are mass produced and, consequently, relatively inexpensive. They are structurally sound and easy and relatively inexpensive to install. Because they comprise concrete, they are durable. They can be given a desired appearance such as a natural stone appearance. Many block systems also use pins that are adapted to fit in corresponding pin holes in adjacent blocks or may use other mechanical means to contribute to the stability of a wall.

Typically, retaining wall blocks are manufactured to have the desired appearance on the front face (i.e., the outer face of a wall) because only the front is typically visible after the wall is constructed. It is highly desirable to have the front face of the wall system have a natural stone appearance, and many approaches are used in the art to treat or process concrete to evoke the appearance of natural stone, including splitting the block, tumbling the block to weather the face and edges of the face, and using processing or texturing equipment to impart a weathered look to the concrete. Colored concrete in various forms and methods also is employed to mimic the look of natural stone.

Depending upon their location, the soil type, the amount of water that can flow through a concrete retaining wall, and the salt content of the concrete, an undesirable appearance can develop on the surface of a retaining wall due to efflorescence. Efflorescence refers to the leaching of mineral salts from concrete by water and this often occurs on walls in contact with water. The resultant deposit on a surface creates an unattractive white, stained appearance on a wall. In addition, due to exposure to the elements and freeze/thaw cycles, concrete retaining walls may exhibit spalling, that is, chipping and cracking of concrete, which affects their appearance and can ultimately affect their utility. Freeze-thaw effects are worsened when the wall face is exposed to salt spray, which commonly occurs on roadways where de-icing salts are used to clear the road of ice and snow.

There have been prior efforts to add a veneer to regular masonry and segmental retaining walls with natural stone or concrete that is pre-cast molded to closely resemble natural stone. While such veneering produces aesthetically pleasing walls, it is a laborious and highly expensive process, as it requires skilled masonry work to tie in the stone or concrete veneer to the wall using traditional mortared masonry construction methods. Such veneering can double the cost of the finished wall. In addition, reinforced soil (also known as mechanically stabilized earth (MSE)) segmental retaining walls are not rigid structures and applying a rigid mortared veneer may cause cracking of the veneer pieces or mortar areas unless appropriate steps are taken to provide slip joints that allow for such movement. Additionally, it has been proposed to attach veneers made from various materials to wall blocks or wall surfaces using a connecting means that does not require mortar. Although such veneers are advantageous in many respects improvements are needed. For example, it would be desirable to provide a block for use with a veneer that has been specifically designed and configured to form a wall that can be interlocked for stability and that can be used with veneers and compatible connectors to provide a wall structure that is both aesthetically pleasing and structurally sound. Further, it would be desirable to improve the connectors with which those veneers are attached to the blocks or wall surface and to improve the manner in which the blocks in the wall are connected and stabilized from course to course.

SUMMARY OF THE INVENTION

This invention relates generally to a wall block and veneer panels and a method of constructing walls, retaining walls, free-standing walls or fence systems from the wall blocks and veneer panels. More particularly, the invention relates to constructing such walls or fence systems wherein a veneer panel is attached to a wall block with a connector and further wherein the front faces of the veneer panels have a desirable texture and further wherein the veneer panels can be connected to the wall blocks before, during or after construction of the wall or fence system.

The invention provides a wall block comprising: parallel top and bottom faces, parallel front and rear faces, and first and second side walls, the first and second side walls extending from the top face to the bottom face and from the front face to the rear face; a pin hole located on the top face of the block; a receiving pocket for receiving a pin, the receiving pocket located on the bottom face of the block and opening onto the bottom face of the block; and a connector channel for receiving a veneer connector that is oriented in the direction from the bottom face to the top face of the block, the connector channel opening into the receiving pocket and one of the front or rear faces of the block.

The invention provides a wall block comprising: parallel top and bottom faces, parallel front and rear faces, and first and second side walls, the first and second side walls extending from the top face to the bottom face and from the front face to the rear face; a pin hole located on the top face of the block; a pin receiving cavity for receiving a pin, the pin receiving cavity located on the bottom face of the block and opening onto the bottom face of the block; and a connector channel for receiving a veneer connector that is oriented in the direction from the bottom face to the top face of the block, the connector channel opening into one of the front or rear faces of the block; the front and rear faces having surface areas and the surface area of the front face being greater than the surface area of the rear face; a larger body portion, a smaller body portion, and two neck portions, the neck portions connecting the larger body portion and the smaller body portion, the front face forming a part of the larger body portion and the rear face forming a part of the smaller body portion; a core and two side voids, the core being encompassed by the larger body portion, the smaller body portion and the two neck portions, and the two side voids being formed by the side walls adjacent the two neck portions; and the pin hole extending from the top face of the block to the pin receiving cavity.

The invention provides a wall block comprising: parallel top and bottom faces, parallel front and rear faces, and parallel first and second side walls, the first and second side walls extending from the top face to the bottom face and from the front face to the rear face; a pin hole located on the top face of the block; a pin receiving cavity for receiving a pin, the pin receiving cavity located on the bottom face of the block and opening onto the bottom face of the block; and a connector channel for receiving a veneer connector that is oriented in the direction from the bottom face to the top face of the block, the connector channel opening into one of the front or rear faces of the block; and a single core, the pin hole extending from the top face of the block to the receiving pocket.

The invention provides a combination comprising a wall block, a veneer, and a veneer connector, the wall block having a front face, the front face of the wall block having a connector channel for receiving a veneer connector, the veneer having a connector channel for receiving a veneer connector, and a veneer connector disposed within the wall block connector channel and the veneer connector channel, wherein the veneer comprises parallel top and bottom faces, parallel front and rear faces, and first and second side surfaces, the first side surface having a first surface portion which angles outward from the front face and a second surface portion which angles inward from the first surface portion towards the rear face.

The invention provides a combination comprising a wall block, a veneer, and a veneer connector, the wall block having a front face, the front face of the wall block having a connector channel for receiving a veneer connector, the veneer having a connector channel for receiving a veneer connector, and a veneer connector disposed within the wall block connector channel and the veneer connector channel, wherein the veneer comprises parallel top and bottom faces, front and rear faces, and first and second side surfaces, the rear face of the veneer having projections and valleys, the valleys extending from the top to the bottom faces.

The invention provides a veneer connector comprising: a first shaft and second shaft, the first shaft being attached to the second shaft by a bridge portion, the first and second shafts being parallel to each other; and the first and second shafts each having vertical friction ribs and horizontal friction ribs located at different portions of each shaft.

The invention provides a veneer connector comprising: a first shaft and second shaft, the first shaft being attached to the second shaft by a bridge portion, the first and second shafts being parallel to each other; the first and second shafts each having vertical friction ribs, the first and second shafts not being offset from each other, the first and second shafts being the same length, and the bridge portion being substantially planar.

The invention provides a veneer connector comprising a shaft and bifurcated horizontal prongs that extend from the shaft.

The invention provides a combination comprising a wall block, a veneer, and a veneer connector: the veneer having a connector channel for receiving a veneer connector; the wall block comprising parallel top and bottom faces, parallel front and rear faces, and first and second side walls, the first and second side walls extending from the top face to the bottom face and from the front face to the rear face; a pin hole located on the top face of the block; a receiving pocket for receiving a pin, the receiving pocket located on the bottom face of the block and opening onto the bottom face of the block; and a connector channel for receiving a veneer connector that is oriented in the direction from the bottom face to the top face of the block, the connector channel opening into the receiving pocket and one of the front or rear faces of the block; the veneer connector comprising a first shaft and second shaft, the first shaft being attached to the second shaft by a bridge portion, the first and second shafts being parallel to each other; and the first and second shafts each having vertical friction ribs and horizontal friction ribs located at different portions of each shaft; and the veneer connector being disposed within the wall block connector channel and the veneer connector channel.

The invention provides a combination comprising a wall block, a veneer, and a veneer connector: the veneer having a connector channel for receiving a veneer connector; the wall block comprising parallel top and bottom faces, parallel front and rear faces, and first and second side walls, the first and second side walls extending from the top face to the bottom face and from the front face to the rear face; a pin hole located on the top face of the block; a receiving pocket for receiving a pin, the receiving pocket located on the bottom face of the block and opening onto the bottom face of the block; and a connector channel for receiving a veneer connector that is oriented in the direction from the bottom face to the top face of the block, the connector channel opening into the receiving pocket and one of the front or rear faces of the block; the veneer connector comprising a shaft, and bifurcated horizontal prongs that extend from the shaft; and the veneer connector being disposed within the wall block connector channel and the veneer connector channel.

The invention provides a wall comprising a first course and a second course of wall blocks, a plurality of wall blocks comprising: parallel top and bottom faces, parallel front and rear faces, and first and second side walls, the first and second side walls extending from the top face to the bottom face and from the front face to the rear face; a pin hole located on the top face of the block; a receiving pocket for receiving a pin, the receiving pocket located on the bottom face of the block and opening onto the bottom face of the block; and a connector channel for receiving a veneer connector that is oriented in the direction from the bottom face to the top face of the block, the connector channel opening into the receiving pocket and one of the front or rear faces of the block.

It is to be understood that both the foregoing general description and the following detailed description are exemplary and explanatory and are intended to provide further explanation of the invention as claimed.

BRIEF DESCRIPTION OF THE DRAWINGS

A preferred form of the present invention will now be described by way of example with reference to the accompanying drawings.

FIGS. 6M to 6P are perspective and top views, respectively, of another embodiment of a veneer connector of the present invention.

FIG. 7G is a top view of a wall formed from an alternative wall system of the present invention.

DETAILED DESCRIPTION OF THE PREFERRED EMBODIMENTS

Figure 1A:
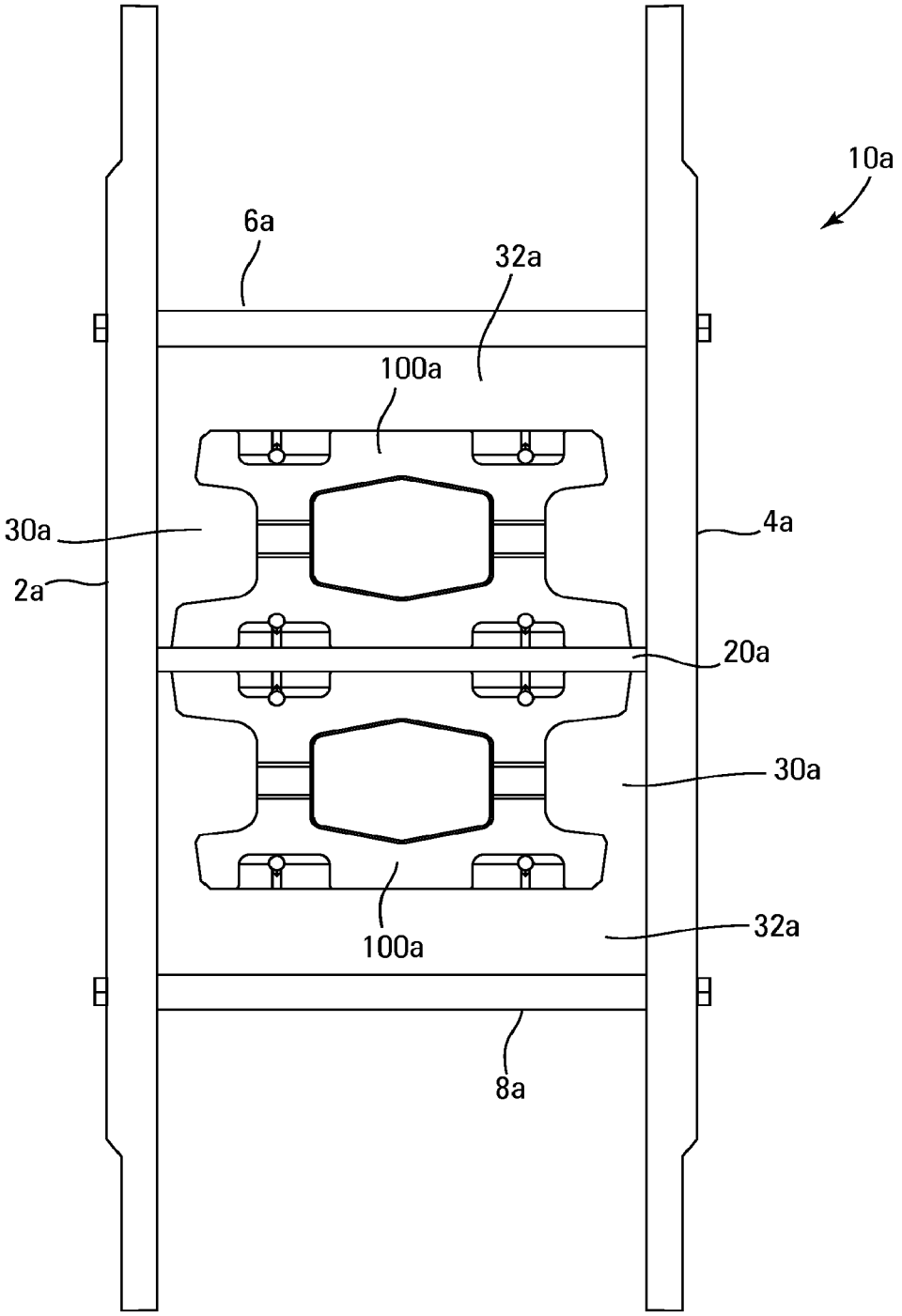
FIG. 1A is a top view of a mold box for a block of the present invention.
Figure 1B:
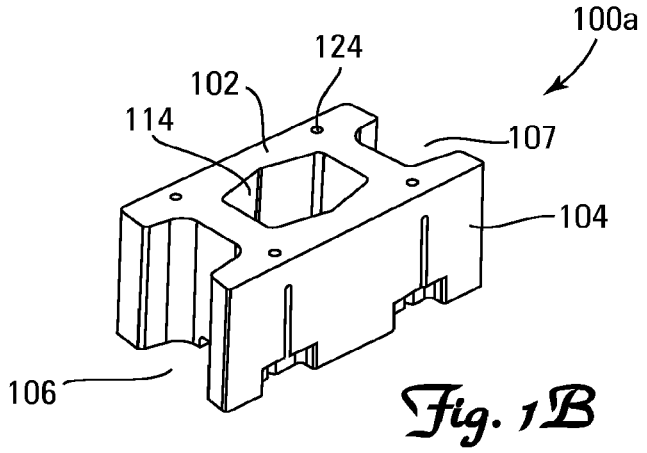
FIGS. 1B to 1D are top perspective, bottom and front views, respectively, of an embodiment of a wall block of the present invention as it would be installed in a wall.

In one embodiment of the invention, veneer panels are used with retaining wall blocks. The retaining wall blocks can be made of a rugged, weather resistant material, preferably (and typically) zero-slump molded concrete. Other suitable materials include polymers, especially high density foam polymers, fiberglass, wood, metal, glass, stone, and composite materials with reinforced fibers, etc. The blocks may have various shapes and characteristics, as known in the art, and may be stacked one upon the other to provide a vertically straight wall, and also may be stacked so that they are angled or set back from vertical. As known in the art, the blocks may be connected to each other by a pin attachment system, or the blocks may be provided with one or more protruding elements that interlock with one or more corresponding recesses in an adjacent block.

"Upper" and "lower" refer to the placement of the block in a retaining wall or fence system. The lower, or bottom, surface is placed such that it faces the ground. In a retaining wall, one row of blocks is laid down, forming a course. An upper course is formed on top of this lower course by positioning the lower surface of one block on the upper surface of another block.

Retaining walls may be straight (i.e., substantially linear, as well as vertically straight or plumb), curved (concave, convex, or serpentine) or may have angled corners (i.e., 90 degree angles, obtuse angles or acute angles of a buildable degree). Such walls can be angled or setback from vertical. Reinforcing geogrid mesh or geosynthetic fabrics (also referred to generally as geogrids and geotextiles) may be used with retaining wall blocks to create a reinforced soil structure where the wall has one exposed face and where the geogrid is attached to the block via the pinning connection and comes out through the back face and into the backfilled soil at desired intervals vertically.

The blocks of this invention are symmetrical about a vertical plane of symmetry. The blocks may optionally be provided with pin holes, pin receiving cavities, and at least one core which serves to decrease the weight of the block while maintaining its strength while also providing ease of construction of a retaining wall. The location, shape, and size of the pin holes and receiving cavities are selected to maximize the strength of the block, as described by reference to the drawings.

The veneer panels of this invention may be comprised of any suitable material such as high strength concrete, polymers, composites, natural stone, metal, wood, glass, porcelain or a mineral aggregate in fiberglass. High strength concrete (6,000 psi and higher) used in the making of the veneer panel may be compacted under vibration and pressure to make the veneer panel extremely durable and strong. Various liquid or dry pigments may be added to the concrete mix in order to create different colors or shades of color. The mold of the veneer panel is configured to impart a surface texture to the material that resembles the texture of natural stone. The high density and strength of the concrete veneer panel make it more resistant to weather and other natural forces.

It is to be emphasized that the surface of a veneer panel may have any desired appearance. A natural appearance, such as stone, is generally most desirable. The panel may have a uniform single stone appearance or it may have an ashlar multi-stone pattern formed into it. The panels may also resemble stone that has been processed or treated as is commonly known in the natural stone industry. For example, the panel may resemble a weathered stone, polished stone, or flame treated stone. In addition, the veneer panels may be molded or configured to produce panels that resemble stone that has been hand or machine pitched or tumbled to produce an aesthetically pleasing natural quarried stone appearance. In addition, the veneer panel can be manufactured to have any desired appearance, whether natural or man made. A combination of geometric forms and shapes, along with natural appearing aesthetics are all possible by adding the veneer panel to the structural support block of this system.

The invention provides a wall block comprising: parallel top and bottom faces, parallel front and rear faces, and first and second side walls, the first and second side walls extending from the top face to the bottom face and from the front face to the rear face; a pin hole located on the top face of the block; a receiving pocket for receiving a pin, the receiving pocket located on the bottom face of the block and opening onto the bottom face of the block; and a connector channel for receiving a veneer connector that is oriented in the direction from the bottom face to the top face of the block, the connector channel opening into the receiving pocket and one of the front or rear faces of the block. In one embodiment, the receiving pocket is located on the bottom face of the block opens into the front face of the block. In an embodiment, the front and rear faces have surface areas and the surface area of the front face is greater than the surface area of the rear face. In an embodiment, the wall block comprises a larger body portion, a smaller body portion, and two neck portions, the neck portions connecting the larger body portion and the smaller body portion, the front face forming a part of the larger body portion and the rear face forming a part of the smaller body portion. In one embodiment, the wall block comprises a core and two side voids, the core being encompassed by the larger body portion, the smaller body portion and the two neck portions, and the two side voids being formed by the side walls adjacent the two neck portions. In one embodiment, the pin hole extends from the top face of the block to the receiving pocket. In an embodiment, the bottom surface of the block in the two neck portions has receiving channels for receiving a reinforcement member.

In an embodiment, the connector channel that is oriented in the direction from the bottom face to the top face of the block and opens onto the front face of the block, opens onto the front face from the bottom face to the top face of the block. In another embodiment, the connector channel that is oriented in the direction from the bottom face to the top face of the block and opens onto the front face of the block, does not open onto the front face for the entire distance from the bottom face to the top face of the block. In an embodiment, the connector channel opens onto the front face of the block from the receiving pocket to a point below the top face of the block.

In an embodiment, the connector channel that is oriented in the direction from the bottom face to the top face of the block and opens onto the front face of the block, opens onto the front face from the receiving pocket to the top face of the block. In one embodiment, the connector channel that is oriented in the direction from the bottom face to the top face of the block and opens onto the front face of the block, does not open onto the front face for the entire distance from the bottom face to the top face of the block. In an embodiment, the connector channel opens onto the front face of the block from the receiving pocket to a point below the top face of the block.

In one embodiment, wherein the bottom face of the block comprises four receiving pockets and the top face of the block comprises four pin holes. In an embodiment, the wall block comprises two connector channels opening onto the front face of the block and two connector channels opening onto the rear face of the block.

In an embodiment, the front and rear faces have surface areas and the surface area of the front face is equal to the surface area of the rear face, and the first and second side walls are parallel. In one embodiment, the bottom face of the block comprises only six receiving pockets and the top face of the block comprises only six pin holes. In an embodiment, the wall block comprises two connector channels opening onto the front face of the block, two connector channels opening onto the rear face of the block, and one connector channel opening onto each of the first and second side walls. In one embodiment, the wall block has only two cores. In an embodiment, the bottom surface of the block has a receiving channel for receiving a reinforcement member.

The invention provides a wall block comprising: parallel top and bottom faces, parallel front and rear faces, and first and second side walls, the first and second side walls extending from the top face to the bottom face and from the front face to the rear face; a pin hole located on the top face of the block; a pin receiving cavity for receiving a pin, the pin receiving cavity located on the bottom face of the block and opening onto the bottom face of the block; and a connector channel for receiving a veneer connector that is oriented in the direction from the bottom face to the top face of the block, the connector channel opening into one of the front or rear faces of the block; the front and rear faces having surface areas and the surface area of the front face being greater than the surface area of the rear face; a larger body portion, a smaller body portion, and two neck portions, the neck portions connecting the larger body portion and the smaller body portion, the front face forming a part of the larger body portion and the rear face forming a part of the smaller body portion; a core and two side voids, the core being encompassed by the larger body portion, the smaller body portion and the two neck portions, and the two side voids being formed by the side walls adjacent the two neck portions; and the pin hole extending from the top face of the block to the pin receiving cavity. In one embodiment, the bottom surface of the block has a receiving channel for receiving a reinforcement member. In an embodiment, the connector channel that is oriented in the direction from the bottom face to the top face of the block and opens onto the front face of the block, opens onto the front face from the bottom face to the top face of the block.

The invention provides a wall block comprising: parallel top and bottom faces, parallel front and rear faces, and parallel first and second side walls, the first and second side walls extending from the top face to the bottom face and from the front face to the rear face; a pin hole located on the top face of the block; a pin receiving cavity for receiving a pin, the pin receiving cavity located on the bottom face of the block and opening onto the bottom face of the block; and a connector channel for receiving a veneer connector that is oriented in the direction from the bottom face to the top face of the block, the connector channel opening into one of the front or rear faces of the block; and a single core, the pin hole extending from the top face of the block to the receiving pocket.

The invention provides a combination comprising a wall block, a veneer, and a veneer connector, the wall block having a front face, the front face of the wall block having a connector channel for receiving a veneer connector, the veneer having a connector channel for receiving a veneer connector, and a veneer connector disposed within the wall block connector channel and the veneer connector channel, wherein the veneer comprises parallel top and bottom faces, parallel front and rear faces, and first and second side surfaces, the first side surface having a first surface portion which angles outward from the front face and a second surface portion which angles inward from the first surface portion towards the rear face.

The invention provides a combination comprising a wall block, a veneer, and a veneer connector, the wall block having a front face, the front face of the wall block having a connector channel for receiving a veneer connector, the veneer having a connector channel for receiving a veneer connector, and a veneer connector disposed within the wall block connector channel and the veneer connector channel, wherein the veneer comprises parallel top and bottom faces, front and rear faces, and first and second side surfaces, the rear face of the veneer having projections and valleys, the valleys extending from the top to the bottom faces.

The invention provides a veneer connector comprising: a first shaft and second shaft, the first shaft being attached to the second shaft by a bridge portion, the first and second shafts being parallel to each other; and the first and second shafts each having vertical friction ribs and horizontal friction ribs located at different portions of each shaft. In an embodiment, the first and second shafts are offset from each other. In one embodiment, the first and second shafts are the same length. In an embodiment, the bridge portion is substantially planar. In one embodiment, the vertical friction ribs of the first shaft point in the opposite direction as the vertical friction ribs of the second shaft. In an embodiment, the first shaft is longer than the second shaft and includes a projection that can function as a pin.

The invention provides a veneer connector comprising: a first shaft and second shaft, the first shaft being attached to the second shaft by a bridge portion, the first and second shafts being parallel to each other; the first and second shafts each having vertical friction ribs, the first and second shafts not being offset from each other, the first and second shafts being the same length, and the bridge portion being substantially planar.

The invention provides a veneer connector comprising a shaft and bifurcated horizontal prongs that extend from the shaft. In an embodiment, the shaft has upper, middle, and lower portions, the upper and lower portions having horizontal friction ribs, and the middle portion having bifurcated horizontal prongs. In one embodiment, the bifurcated horizontal prongs comprise tabs at ends of the prongs. In an embodiment, the bifurcated horizontal prongs comprise tabs at ends of the prongs.

The invention provides a combination comprising a wall block, a veneer, and a veneer connector: the veneer having a connector channel for receiving a veneer connector; the wall block comprising parallel top and bottom faces, parallel front and rear faces, and first and second side walls, the first and second side walls extending from the top face to the bottom face and from the front face to the rear face; a pin hole located on the top face of the block; a receiving pocket for receiving a pin, the receiving pocket located on the bottom face of the block and opening onto the bottom face of the block; and a connector channel for receiving a veneer connector that is oriented in the direction from the bottom face to the top face of the block, the connector channel opening into the receiving pocket and one of the front or rear faces of the block; the veneer connector comprising a first shaft and second shaft, the first shaft being attached to the second shaft by a bridge portion, the first and second shafts being parallel to each other; and the first and second shafts each having vertical friction ribs and horizontal friction ribs located at different portions of each shaft; and the veneer connector being disposed within the wall block connector channel and the veneer connector channel. In an embodiment, the veneer comprises parallel top and bottom faces, parallel front and rear faces, and first and second side surfaces, the first side surface having a first surface portion which angles outward from the front face and a second surface portion which angles inward from the first surface portion towards the rear face. In an embodiment, the veneer comprises parallel top and bottom faces, front and rear faces, and first and second side surfaces, the rear face of the veneer having projections and valleys, the valleys extending from the top to the bottom faces. In one embodiment, the veneer comprises parallel top and bottom faces, front and rear faces, and first and second side surfaces, and the front face of the block is the same size as the rear face of the veneer. In an embodiment, the veneer comprises parallel top and bottom faces, front and rear faces, and first and second side surfaces, and the front face of the block is a smaller size than the rear face of the veneer. In an embodiment, the wall block is a concrete wall block. In an embodiment, the veneer is a pre-cast concrete veneer. In an embodiment, the veneer comprises a polymer. In one embodiment, the veneer is a real stone veneer. In one embodiment, the receiving pocket located on the bottom face of the wall block opens into the front face of the block. In one embodiment, the first and second shafts of the veneer connector are offset from each other.

The invention provides a combination comprising a wall block, a veneer, and a veneer connector: the veneer having a connector channel for receiving a veneer connector; the wall block comprising parallel top and bottom faces, parallel front and rear faces, and first and second side walls, the first and second side walls extending from the top face to the bottom face and from the front face to the rear face; a pin hole located on the top face of the block; a receiving pocket for receiving a pin, the receiving pocket located on the bottom face of the block and opening onto the bottom face of the block; and a connector channel for receiving a veneer connector that is oriented in the direction from the bottom face to the top face of the block, the connector channel opening into the receiving pocket and one of the front or rear faces of the block; the veneer connector comprising a shaft, and bifurcated horizontal prongs that extend from the shaft; and the veneer connector being disposed within the wall block connector channel and the veneer connector channel. In an embodiment, the veneer comprises parallel top and bottom faces, parallel front and rear faces, and first and second side surfaces, the first side surface having a first surface portion which angles outward from the front face and a second surface portion which angles inward from the first surface portion towards the rear face. In one embodiment, the veneer comprises parallel top and bottom faces, front and rear faces, and first and second side surfaces, the rear face of the veneer having projections and valleys, the valleys extending from the top to the bottom faces. In an embodiment, the veneer comprises parallel top and bottom faces, front and rear faces, and first and second side surfaces, and the front face of the block is the same size as the rear face of the veneer. In an embodiment, the receiving pocket located on the bottom face of the wall block opens into the front face of the block. In an embodiment, the shaft of the veneer connector has upper, middle, and lower portions, the upper and lower portions having horizontal friction ribs, and the middle portion having bifurcated horizontal prongs. In one embodiment, the bifurcated horizontal prongs comprise tabs at ends of the prongs.

The invention provides a wall comprising a first course and a second course of wall blocks, a plurality of wall blocks comprising: parallel top and bottom faces, parallel front and rear faces, and first and second side walls, the first and second side walls extending from the top face to the bottom face and from the front face to the rear face; a pin hole located on the top face of the block; a receiving pocket for receiving a pin, the receiving pocket located on the bottom face of the block and opening onto the bottom face of the block; and a connector channel for receiving a veneer connector that is oriented in the direction from the bottom face to the top face of the block, the connector channel opening into the receiving pocket and one of the front or rear faces of the block. In an embodiment, the receiving pocket located on the bottom face of the block opens into the front face of the block. In an embodiment, the wall is a retaining wall. In one embodiment, the wall is a free-standing wall. In an embodiment, the wall comprises a retaining wall and a parapet wall on top of the retaining wall. In an embodiment, veneers are attached to a plurality of the front faces of the blocks. In another embodiment, veneers are attached to a plurality of the front and rear faces of the blocks. In embodiments, the wall is straight or curved. In one embodiment, the wall includes a 90 degree corner. In embodiments, the wall is vertical or has a setback. In an embodiment, the wall is reinforced with geogrid soil reinforcement, internal reinforcement, or a combination of the two.

FIG. 1A illustrates block 100*a* of the present invention formed in a mold box 10*a*. Mold box 10*a* generally includes two or more mold cavities and has opposing first and second side frame walls 2*a* and 4*a* and opposing first and second end frame walls 6*a* and 8*a* but it should be noted that other sized molding machines may have molds with greater cavity capacities. Division plate 20*a* spans side walls 2*a* and 4*a* of mold box 10*a* dividing the mold into two cavities and forms a front face of wall block 100*a* in both mold cavities. Stationary side liners 30*a*, form first and second side walls and stationary back liner 32*a* forms the back face of wall block 100*a* in each cavity. Connector channel/pin hole forming members and receiving pocket forming members (not shown) may be rigidly attached to division plate 20*a* and stationary back liner 32*a* to form each of the pin holes, connector cavities and receiving pockets of block 100*a* discussed in further detail below. Although not shown, a stripper shoe or compression head is used to compact the material in the mold cavities and to aid in discharging the blocks from the mold cavities when the production cycle is complete. Typically, a lower surface of the compression head which contacts the block at the top of the open mold cavity lies in a generally horizontal plane.

Though mold boxes 10*a* may have various dimensions, typical dimensions are about 18.5 inches (47.0 cm) wide (i.e., the width of the first and second end walls), 26.0 inches (66.0 cm) long (i.e., the length of the first and second side walls), and 8 inches (20.4 cm) thick.

The mold boxes of FIG. 1A produce two blocks 100*a* shown in FIGS. 1B to 1F. Blocks 100*a* are made of a rugged, weather resistant material, preferably (and typically) zero-slump molded concrete. Other suitable materials include plastic, reinforced fibers, wood, metal and stone. Block 100*a* has parallel top face 102 and bottom face 103, front face 104, rear face 105 and first and second side walls 106 and 107. Front face 104 and rear face 105 each extend from top face 102 to bottom face 103 and front face 104 has a larger surface area than rear surface 105. It should be noted that front face and rear face are relative terms when constructing a wall from blocks 100*a* and thus rear face 105 could be placed facing outward and form a front face of a wall. Further front face 104 and rear face 105 can both be alternated or some combination thereof depending upon the application when forming a face of a wall. Side walls 106 and 107 extend from top face 102 to bottom face 103 and from front face 104 to rear face 105.

Block 100*a* comprises larger body portion 108, smaller body portion 109 and neck portions 110 which connect the larger body portion 108 to the smaller body portion 109. Front face 104 forms part of the larger body portion 108, while rear face 105 forms part of smaller body portion 109. The larger and smaller body and neck portions 108, 109, and 110 each extend between top and bottom faces 102 and 103 and between first and second side walls 106 and 107. Side walls 106 and 107 are thus of a compound shape and have side voids 112 as a result of the reduced width of neck portions 110 compared to that of body portions 108 and 109. Side walls 106 and 107 also have side surface 111 which is part of the larger body portion 108, and side surface 113 which is part of the smaller body portion 109. Side surface 111 angles inward toward the back of the block and side surface 113 angles outward away from the block. Side surfaces 111 and 113 together form a common side angle to block 100*a*. This common angle preferably is from 5 to 15 degrees and may be 7.5 degrees. Neck portions 110 are generally located at the quarter points of the block to create balance between the space inside core 114 and the side spaces 112 of two adjoining blocks. Quarter points are the midpoints of the two segments produced by dividing the front face of the block at its midpoint.

Opening or core 114 extends through neck portion 110 from top face 102 to bottom face 103. Core 114 and side voids 112 also reduce the weight of block 100*a*; lower block weight is both a manufacturing advantage and an advantage when constructing a wall from the blocks as it reduces cost due to less material and makes lifting of the blocks easier. Cores 114 and side voids 112 also allow the structure being constructed with the blocks to utilize vertical reinforcing members such as rebar to increase durability and strengthen the structure.

Figure 1C:
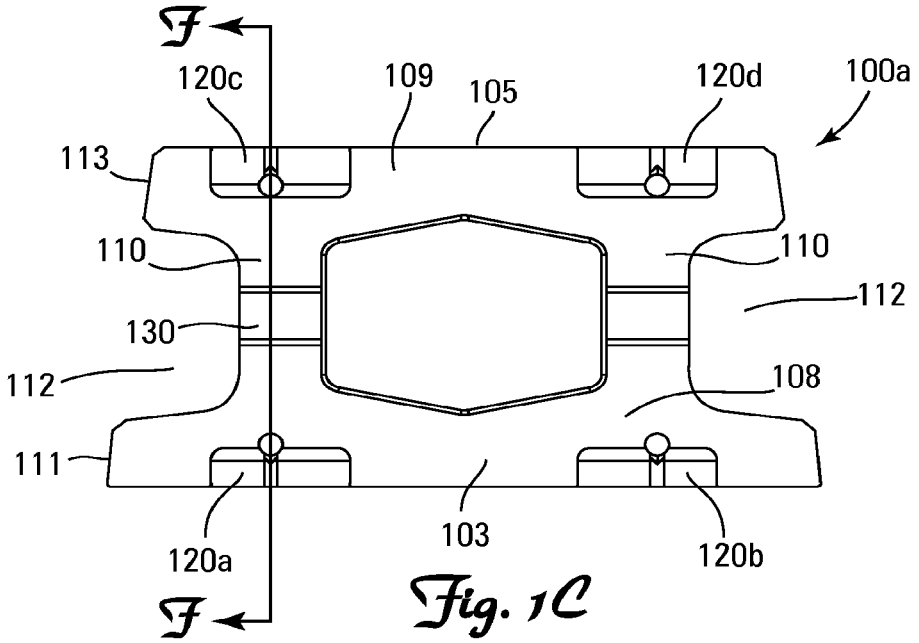
Figure 1D:
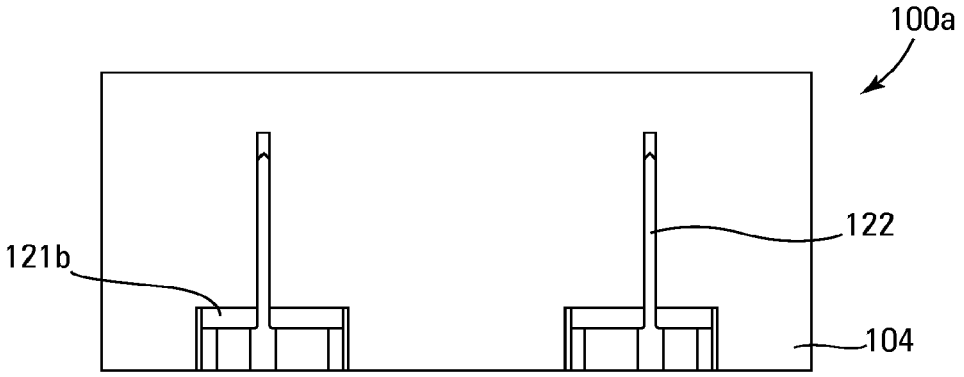
Figure 1E:
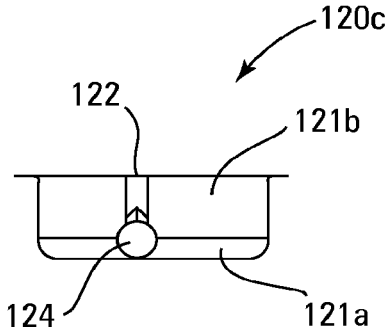
FIG. 1E is a bottom view of a receiving pocket of a wall block of the present invention.
Figure 1F:
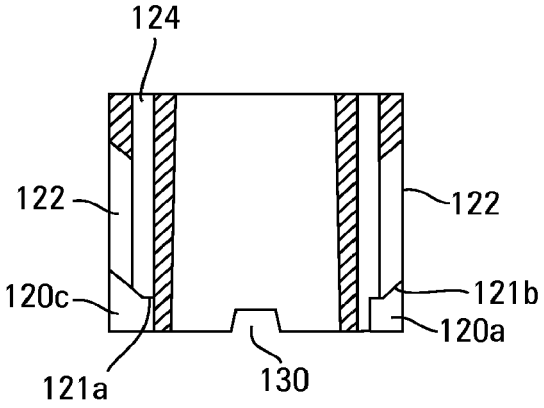
FIG. 1F is a cross-sectional view of the block of FIG. 1B.

FIG. 1F is a vertical cross-sectional view of block 100*a* taken along line F-F in FIG. 1C. Receiving cavities or pockets 120*a* and 120*c* are shown in cross section in FIG. 1F. Pocket 120*a* is located in body portion 108 and pocket 120*c* is located in body portion 109. Pockets 120*a* and 120*c* extend a predetermined depth into the bottom surface 103 and also extend a predetermined depth into front face 104. The configuration of pockets 120*b* and 120*d* are similar and are not separately shown. Receiving pockets 120*c* and 120*d* extend further into back face 105 than receiving pockets 120*a* and 120*b* extend into front face 104, thus receiving pockets 120*c* and 120*d* are larger than receiving pockets 120*a* and 120*b*. It should be noted that this is not limiting and the receiving pockets could all be the same size or could all have differing sizes depending upon the application.

FIG. 1E is a bottom view of receiving pocket 120*c* and is generally representative of the shape and configuration of each of the receiving pockets. Pocket 120*c* has an upper surface which includes a substantially horizontal portion 121*a* and an inclined portion 121*b*. Portion 121*a* is substantially horizontal and generally parallel to the top and bottom faces of the block while surface 121*b* of the upper surface of receiving pockets 120*c* has an angular incline from horizontal. This incline may have any angle but may preferably be in the range of 30 to 45 degrees. The angular incline of receiving pockets 120*a/b/c/d* is produced as an area of decline in the mold cavity with the bottom face 103 facing upward and is formed by the receiving pocket forming member that is attached to mold box 10*a*, division plate 20*a* and stationary end wall liner 32*a*. This angular decline relative to the bottom surface of the block as it sits facing upward in the mold box helps to even the distribution of material through vibratory action and compaction to form a more structurally sound block.

Receiving pockets 120*a/b/c/d* receive a head of a pin placed in an adjacent lower course of blocks which is described in further detail below. Receiving pockets 120*a* and 120*b* are sized to allow for setback/offset from vertical in the construction of a structure while the size of receiving pockets 120*c* and 120*d* allow for generally no setback in the construction of a substantially vertical structure.

Front face 104 and back face 105 have connector channels 122 which extend from surface 121*a* of the upper surface of receiving pockets 120*a/b/c/d* upward a predetermined distance towards top surface 102. Pin holes 124 are located in body portions 108 and 109 and extend from top surface 102 to surface 121*a* of the upper surface of receiving pockets 120*a/b/c/d*. Pin holes open into connector channels 122 of the front face 104 and rear face 105 and together have a predetermined depth specifically sized to receive and secure the veneer connectors/clips which are connected or can be connected to veneer face panels which are described below. It is to be understood that commonly, though not always, the reference to a veneer clip being inserted into the connector channel of a block herewith may refer to a shaft of the veneer clip being received into the pin hole through surface 121*a* of the receiving pocket and a bridge of the veneer clip being received into the connector channel.

Figure 2A:
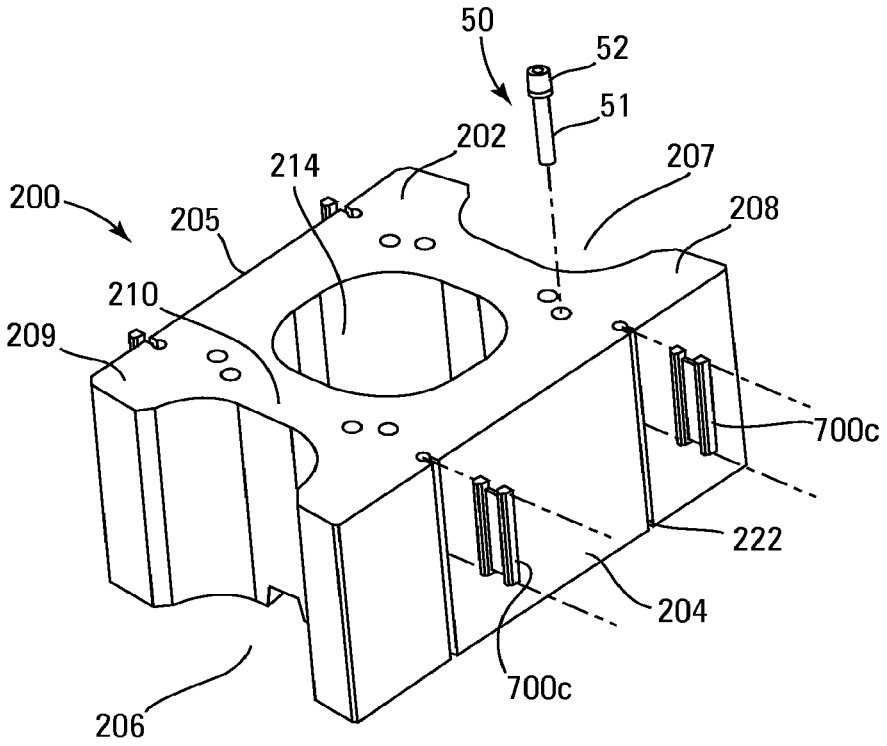
FIGS. 2A and 2B are top perspective and bottom views, respectively, of an alternative embodiment of a block of the present invention.

Pin 50, as shown in FIG. 2A, has a shaft 51 which is placed into a pin hole of a top surface in a lower course of blocks when constructing a wall and the pin 50 also has a head 52 which projects from the top surface of the block of the lower course and abuts to the perpendicular rear wall of receiving pocket 218 of a block in an upper course of a constructed structure. The head 52 of the pin may have a larger diameter than the shaft 51 and may also be tapered, square, round or any other desired shape. Additionally the shaft 51 of the pin may be circular, square or any other desired shape as well. In this manner, the pin in a block on a lower course of blocks in a wall engages the receiving pocket 218 of a block in an upper course. This results in an interlocking of the blocks with a predetermined setback using pin holes 216, or no setback using pin holes 217. It is to be understood that the shape of the pin is not limiting and could be for example uniformly shaped with no head or could have any other number of features.

Bottom surface 103 has receiving channel 130 located in neck portions 110. Receiving channel 130 extends through the length of the neck as shown and opens onto side surfaces 111 and 113 of side walls 106 and 107 and into the core 114. The receiving channel may be of sufficient width and depth as to accommodate a horizontal reinforcing member such as rebar to help strengthen the wall depending upon the application or may accommodate layers of soil retention material such as geogrid. The receiving channel may specifically have a depth of ¼ of an inch to 1 inch (12.7 to 25.4 mm) but may be wider or narrower depending upon the application.

Though the blocks illustrated in the FIGS. 1A to 1F may have various dimensions, block 100*a* typically has a height (i.e., the distance between surfaces 102 and 103) of about 8 inches (200 mm), a front face length (i.e., the distance from side surface 111 of side wall 106 to side surface 111 of side wall 107) of about 18 inches (457 mm), a back face length (i.e., the distance from side surface 113 of side wall 106 to side surface 113 of side wall 107) of about 15.25 inches (388 mm), and a width (i.e., the distance from front face 104 to rear face 105) of about 9 inches (225 mm).

Figure 1G:
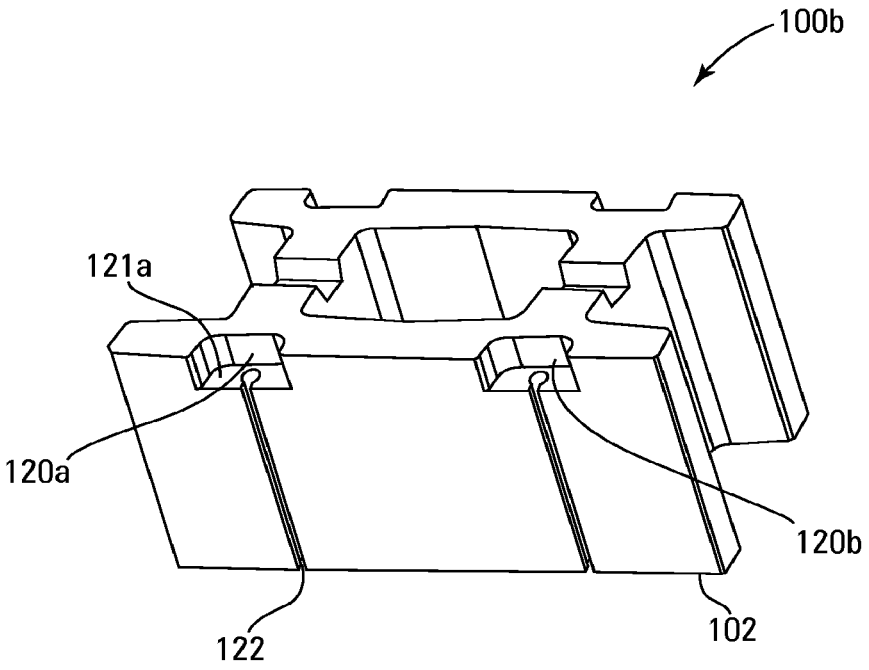
FIG. 1G is a bottom perspective view of an alternative embodiment of the block of FIG. 1B.

An alternative embodiment of the block is shown in FIG. 1G. Block 100*b* is substantially the same as block 100*a* except that connector channels 122 extend from surface 121*a* (which extends the entire upper surface of receiving pockets 120*a/b/c/d*) of the upper surface of receiving channels 120*a/b/c/d* to the top surface 102 of block 100*b*. It should be noted that this is not limiting and that the connector channels could all be the same length or could have varying lengths depending upon the application.

Figure 2B:
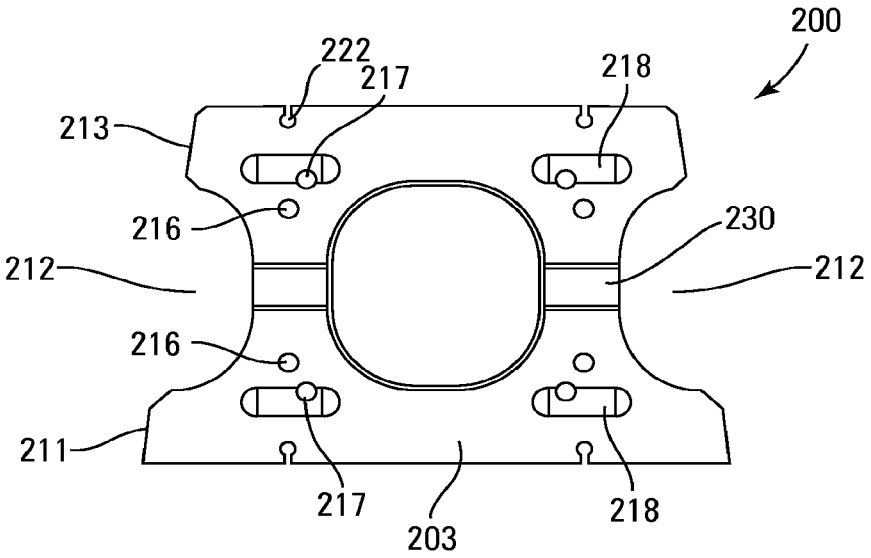

Another embodiment of the block is shown in FIGS. 2A and 2B. Block 200 has parallel top face 202 and bottom face 203, front face 204, rear face 205 and first and second side walls 206 and 207. Front face 204 and rear face 205 each extend from top face 202 to bottom face 203. It should be noted that front face and rear face are relative terms when constructing a wall from blocks 200 and thus rear face 205 could be placed facing outward and form a front face of a wall. Further front face 204 and rear face 205 can both be alternated or some combination thereof depending upon the application when forming a face of a wall. Side walls 206 and 207 extend from top face 202 to bottom face 203 and from front face 204 to rear face 205.

Block 200 comprises larger body portion 208, smaller body portion 209 and neck portions 210 which connect the larger body portion 208 to the smaller body portion 209. Front face 204 forms part of the larger body portion 208, while rear face 205 forms part of smaller body portion 209. The larger and smaller body and neck portions 208, 209, and 210 each extend between top and bottom faces 202 and 203 and between first and second side walls 206 and 207. Side walls 206 and 207 are thus of a compound shape and have side voids 212 as a result of the reduced width of neck portions 210 compared to that of body portions 208 and 209. Side walls 206 and 207 also have side surface 211 which is part of the larger body portion 208, and side surface 213 which is part of the smaller body portion 209.

Opening or core 214 extends through neck portion 210 from top face 202 to bottom face 203. Core 214 and side voids 212 also reduce the weight of block 200; lower weight block is both a manufacturing advantage and an advantage when constructing a wall from the blocks as it reduces cost due to less material and makes lifting of the blocks easier. Having a balanced through core 214 with two abutting side voids 212 leads to an effective filling of stone core fill and distribution of frictional connection to geogrid mesh material.

Bottom surface 203 has receiving channel 230 located in neck portions 210. Receiving channel 230 may extend a portion of the length of the neck as shown and may open onto side surfaces 211 of side walls 206 and 207 and into the core 214. The receiving channel may be of sufficient width and depth as to accommodate a horizontal reinforcing member such as rebar to help strengthen the wall depending upon the application or may accommodate layers of soil retention material such as geogrid. The receiving channel may specifically have a depth of ¼ of an inch to one inch (12.7 to 25.4 mm) but may be wider or narrower depending upon the application.

Front face 204 and back face 205 have connector channels 222 which extend from top surface 202 to bottom surface 203. Connector channels have a predetermined depth that is sized to receive and secure the veneer connectors which are connected to the veneer face panels.

Bottom face 203 of block 200 has pin receiving cavities 218 which are located in body portions 208 and 209 and extend a portion of the distance between top and bottom faces 202 and 203, i.e., opening onto the bottom surface but not the top surface. This is not limiting however and the pin receiving cavities may extend the entire distance between the top and bottom faces depending upon the application. Pin receiving cavities 218 may be slot shaped, that is, the cavities are curvilinear, having no sharp angles. The shape and size and location of the cavities are selected to maximize the strength of the block while at the same time reduce the weight of the block.

Pin holes 216 and 217, i.e., first and second pin holes respectively, are located in body portions 208 and 209 of the block. The first pin holes 216 are positioned away from pin receiving cavities 218 and slightly set back towards receiving channel 230 of bottom face 203 and towards side walls 206 and 207. Second pin holes 217 are positioned to open into pin receiving cavities 218 of the block and are located towards front and back faces 204 and 205, respectively, of the block relative to pin holes 216. The location of the pin holes forms four pairs of pinholes located around the central core 214 of the block and provides a way to connect courses of block to another course to strengthen the wall and structure being built and also provides a way to offset the stacking of the blocks when constructing a wall depending upon the application.

Pin holes typically extend through to bottom face 203 and are sized to receive pin 50 which is shown in FIG. 2A. First pin holes 216 provide increased setback as compared to that provided by second pin holes 217. Further pin holes can be provided, if desired, so as to provide for further choices of predetermined setback. Additionally, the location of the pin holes in the body of the block may be varied as desired as well as the location of the pin receiving cavities.

Though the blocks illustrated in the FIGS. 2A and 2B may have various dimensions, block 200 typically has a height (i.e., the distance between surfaces 202 and 203) of about 8 inches (200 mm), a front face length (i.e., the distance from side surface 211 of side wall 206 to side surface 211 of side wall 207) of about 18 inches (457 mm), a back face length (i.e., the distance from side surface 213 of side wall 206 to side surface 213 of side wall 207) of about 15.25 inches (388 mm), and a width (i.e., the distance from front face 204 to rear face 205) of about 12 inches (300 mm).

Figure 3A:
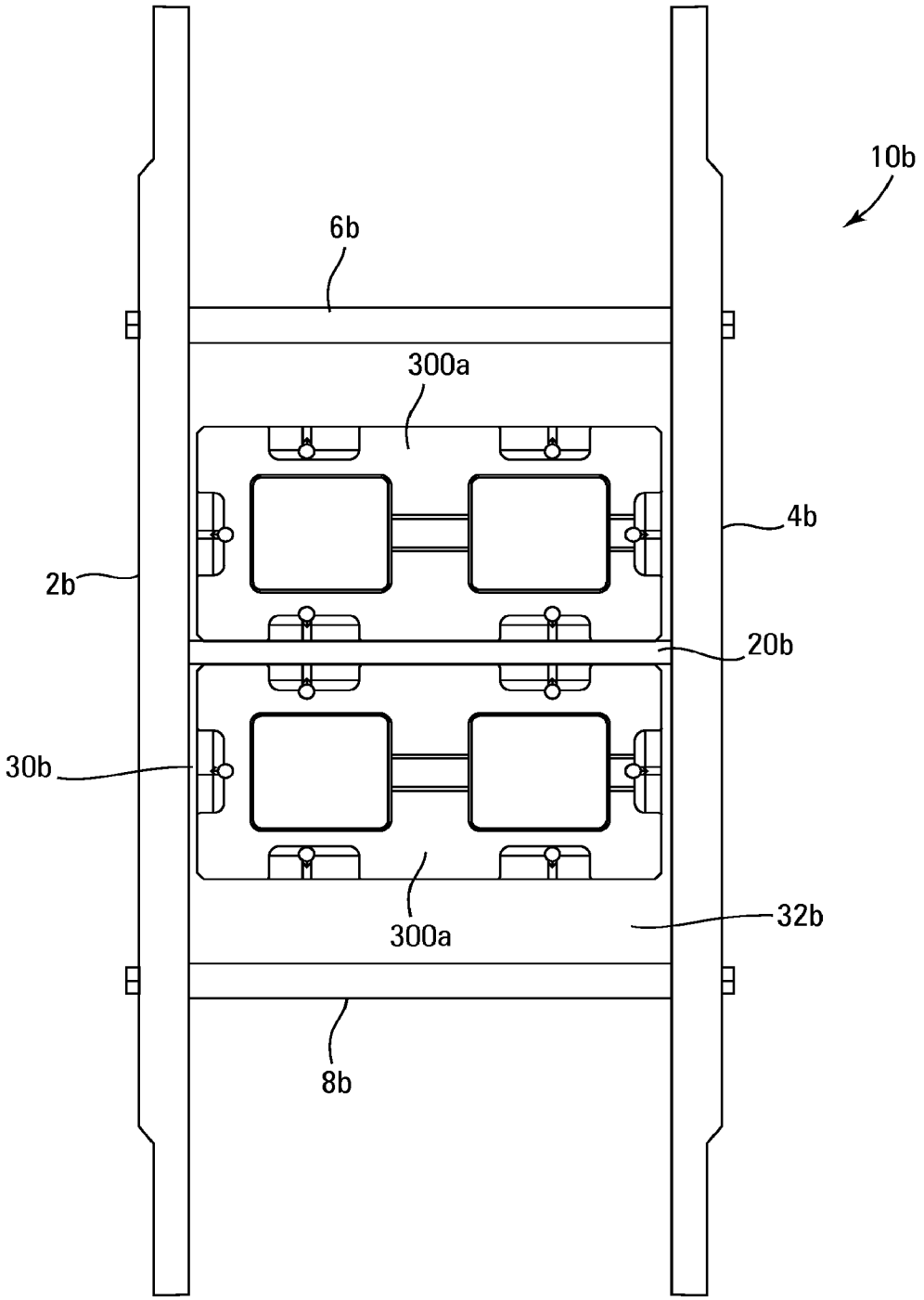
FIG. 3A is a top view of a mold box for a corner block of the present invention.

FIG. 3A illustrates corner block 300*a* of the present invention formed in a mold box 10*b*. Mold box 10*b* generally includes two mold cavities and has opposing first and second side frame walls 2*b* and 4*b* and opposing first and second end frame walls 6*b* and 8*b*. Division plate 20*b* spans side walls 2*b* and 4*b* of mold box 10*b* dividing the mold into two cavities and forms a front face of block 300*a* in both mold cavities. Stationary side liners 30*b*, form first and second side walls and stationary back liner 32*b* forms the back face of wall block 300*a*. Pin hole forming members, connector channel forming members and receiving pocket forming members (not shown) may be rigidly attached to division plate 20*b* and stationary back liner 32*b* to form each of the pin holes, connector cavities and receiving pockets of block 300*a* discussed in further detail below. Although not shown, a stripper shoe or compression head is used to compact the material in the mold cavities and to aid in discharging the blocks from the mold cavities when the production cycle is complete. Typically, a lower surface of the compression head which contacts the block at the top of the open mold cavity lies in a generally horizontal plane.

Figure 3B:
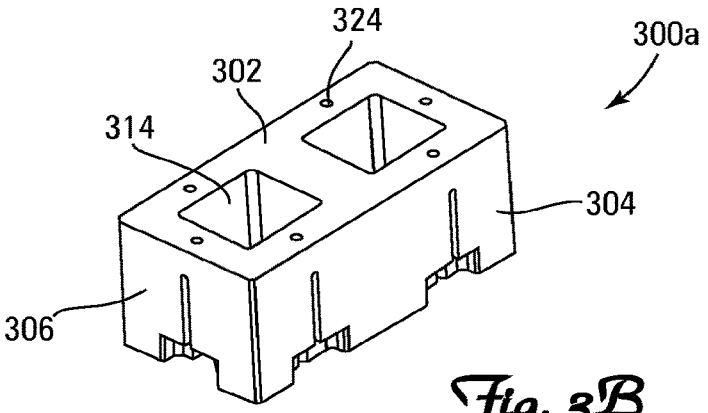
FIGS. 3B to 3D are perspective, bottom and side views, respectively, of an embodiment of a corner block of the present invention.
Figure 3C:
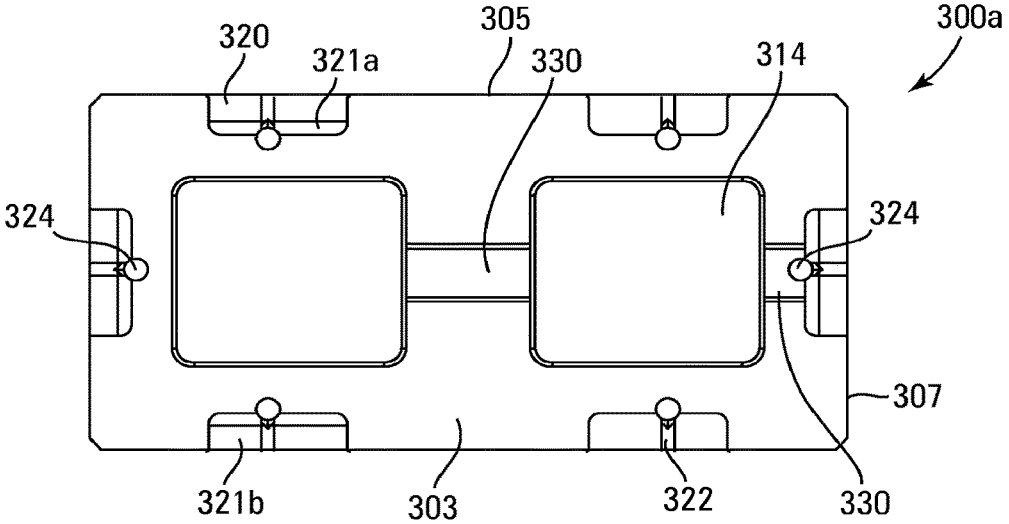
Figure 3D:
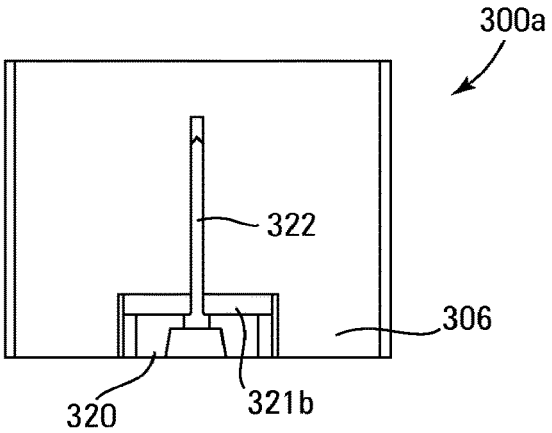

FIGS. 3B, 3C and 3D illustrate corner block 300*a* of the present invention. Corner block 300*a* has parallel top face 302 and bottom face 303, front face 304, rear face 305 and first and second side walls 306 and 307. Front face 304 and rear face 305 each extend from top face 302 to bottom face 303. Side walls 306 and 307 extend from top face 302 to bottom face 303 and from front face 304 to rear face 305. Cores 314 also extend from top face 302 to bottom face 303.

Bottom surface 303, front face 304, back face 305 and side faces 306 and 307 of corner block 300*a* each have receiving cavities or pockets 320 that extend a predetermined depth into the bottom surface 303 and also extend a predetermined depth into one of front face 304, back face 305 and side faces 306 and 307. The receiving pockets 320 receive the head of pin 50 from a course of blocks adjacently below. It should be noted that the receiving pockets could all be the same size or could all have differing sizes depending upon the application. The configuration, structure and function of receiving pockets 320 is similar to that described earlier with respect to receiving pockets 120*a/b/c/d* of block 100*a*. The surfaces 321*a* of the upper surface of receiving pockets 320 are substantially horizontal and extend a predetermined distance while surface 321*b* of the upper surfaces of receiving pockets 320 have an angular incline from horizontal. The angular incline of receiving pockets 320 is produced as an area of decline in the mold cavity with the bottom face 303 facing upward and is formed by the receiving pocket forming member that is attached to mold box 10 division plate 20 and stationary back and side wall liners 30 and 32.

Front face 304, back face 305 and side walls 306 and 307 have connector channels 322 which extend from surface 321*a* of the upper surface of receiving pockets 320 upward a predetermined distance towards top surface 302. Connector channels have a predetermined depth specifically sized to receive and secure the veneer clips which are connected or can be connected to veneer face panels which are described below. Corner block 300*a* also has pinholes 324 which extend from surface 321*a* to top surface 302. As best seen in FIG. 3B there are six pinholes 324, two along each face and one along each side wall.

Though the blocks illustrated in the FIGS. 3A to 3D may have various dimensions, block 300*a* typically has a height (i.e., the distance between surfaces 302 and 303) of about 8 inches (200 mm), front and back face lengths (i.e., the distance from side face 306 to side face 307) of about 18 inches (457 mm), and a width (i.e., the distance from front face 304 to rear face 305) of about 12 inches (300 mm).

Bottom surface 303 has receiving channel 330 that may open into one (as shown) or both of block 300*a* side walls and may be of sufficient width and depth as to accommodate a horizontal reinforcing member such as rebar to help strengthen the wall depending upon the application or may accommodate layers of soil retention material such as geogrid.

Figure 3E:
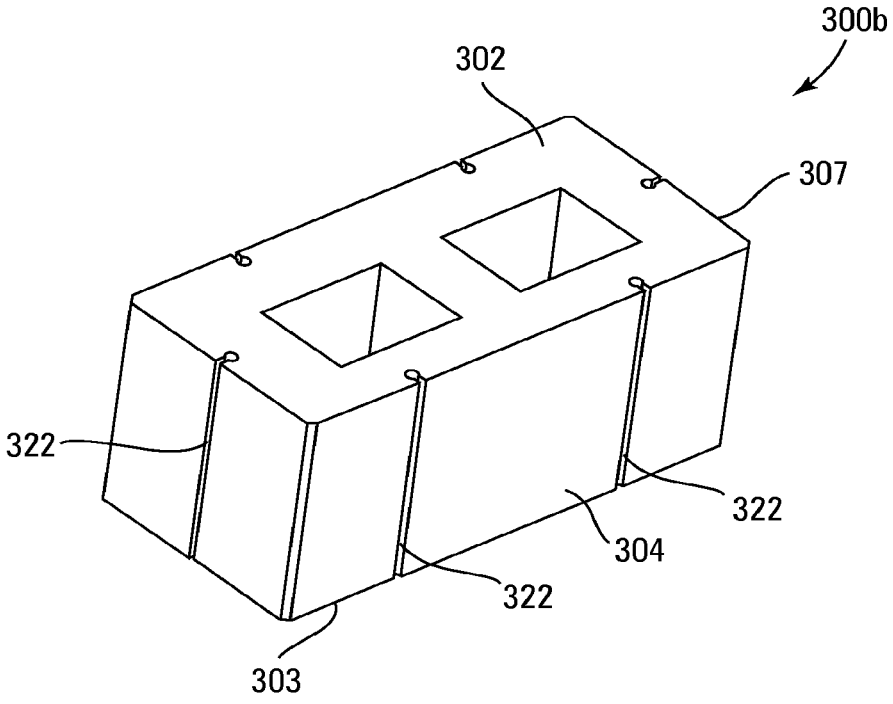
FIG. 3E is a perspective view of an alternative embodiment of the corner block of FIG. 3B.

An alternative embodiment of corner block 300*a* is shown in FIG. 3E. Block 300*b* is substantially the same as corner block 300*a* except that connector channels 322 extend from top surface 302 of block 300*b* to the lower surface 303 of the block. It should be noted that this is not limiting and that the connector channels could all be the same length or could have varying lengths depending upon the application.

Figure 4A:
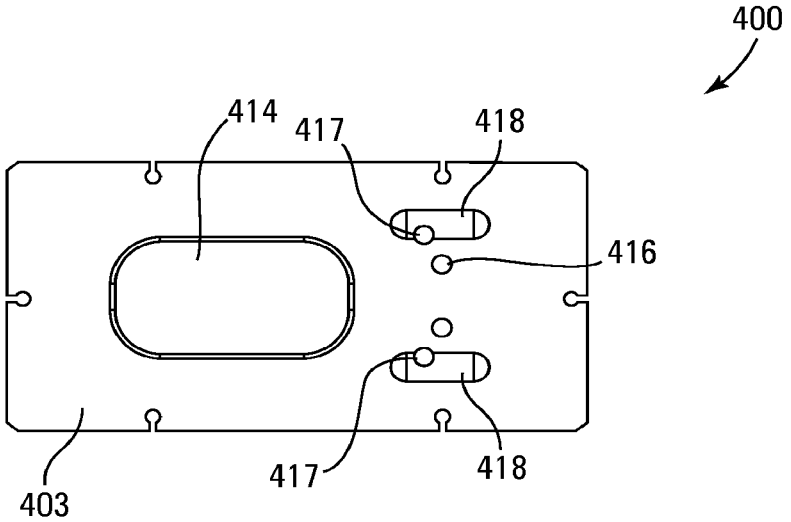
FIGS. 4A and 4B are bottom and top perspective views, respectively, of an alternative embodiment of a corner block of the present invention.
Figure 4B:
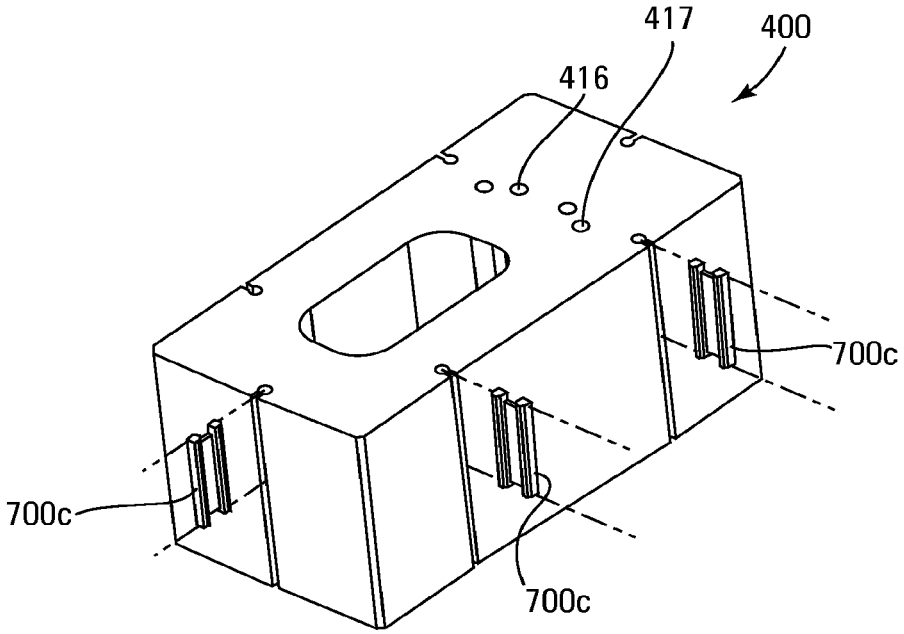

FIGS. 4A and 4B illustrate corner block 400 of an alternative embodiment of the present invention. Corner block 400 is substantially similar to corner block 300*a* except that it does not have receiving pockets 320 and only has a single core 414. Additionally, bottom face 403 of corner block 400 has first and second pin receiving cavities 418 which extend a portion of the distance between the top and bottom faces 402 and 403, i.e., opening onto the bottom face but not the top face. This is not limiting however and the pin receiving cavities may extend the entire distance between the top and bottom faces depending upon the application. Block 400 also has first pin holes 416 which are positioned away from pin receiving cavities 418 and second pin holes 417 which are positioned to open into the pin receiving cavities 418 of the corner block. Pins 50 are used in these cavities to interlock courses of block together in a near vertical or positive setback orientation. The location of the pin holes provides a way to connect adjacent courses of corner blocks together. Corner block 400 can be used in a wall system with previously described block 200 as shown in FIGS. 2A and 2B.

Figure 5A:
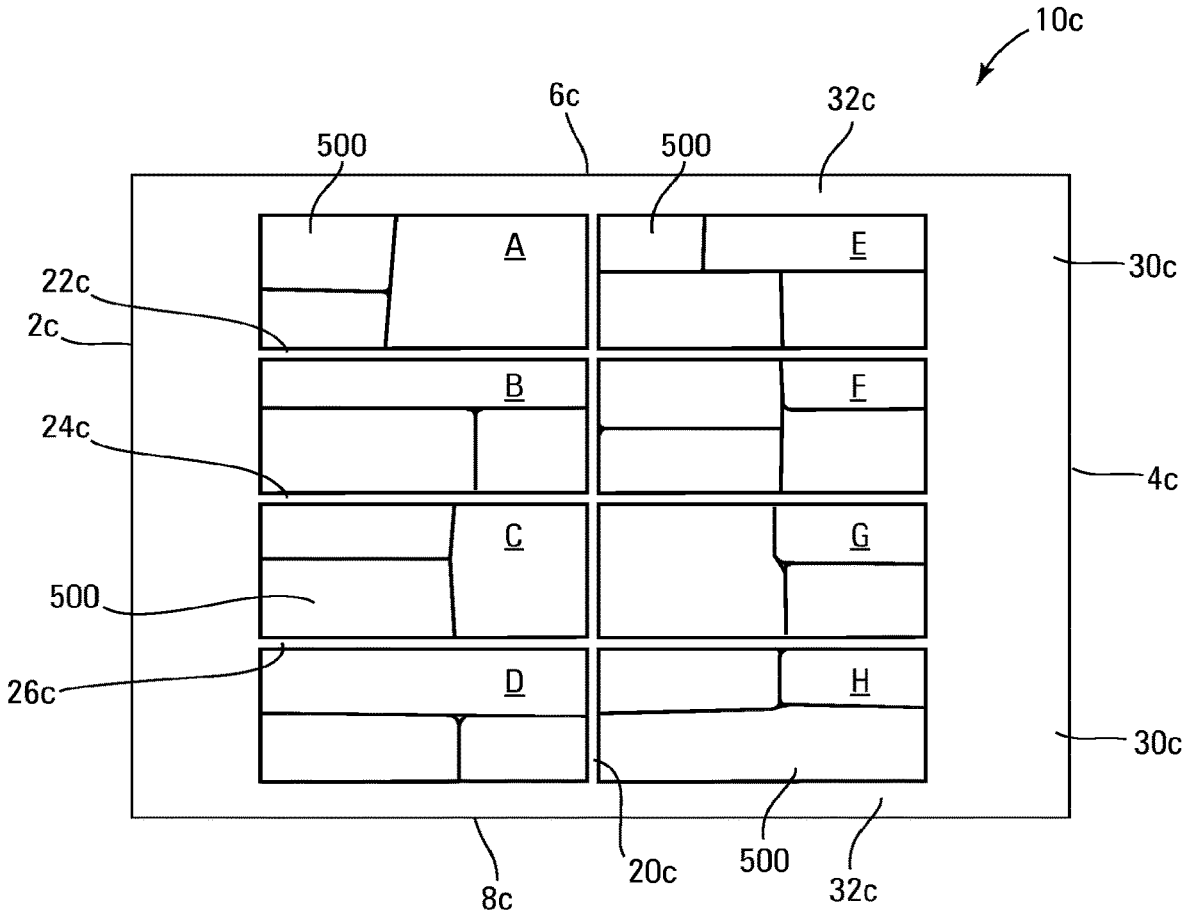
FIG. 5A is a top view of a mold box for veneer panels of the present invention.

FIG. 5A illustrates the manufacture of eight veneer blocks or panels 500 of the present invention formed in a mold box 10*c*. Mold box 10*c* generally includes 8 mold cavities and has opposing first and second side frame walls 2*c* and 4*c* and opposing first and second end frame walls 6*c* and 8*c*. Division plate 20*c* spans side walls 6*c* and 8*c* of mold box 10*c* while division plates 22*c*, 24*c* and 26*c* span end walls 2*c* and 4*c* dividing the mold into 8 cavities enclosed by stationary side liners 30*c*, and stationary end liners 32*c*. Although not shown, a compression head is used to compact the material in the mold cavities and to aid in discharging the blocks from the mold cavities when the production cycle is complete. Typically, a lower surface of the compression head which contacts the block at the top of the open mold cavity lies in a generally horizontal plane. The compression head may have a texture or pattern to impart such texture or pattern to the portion of the block at the open top and part of the way down the sides of the veneer pieces in the mold cavity.

FIGS. 5B to 5E illustrate veneer blocks or panels 500 of the present invention which have been formed in mold box 10*c*. Veneer panels 500 may be made of a rugged, weather resistant material, preferably (and typically) zero-slump, high strength, molded concrete. Thus, the veneer is typically made of higher quality concrete than the block. Other suitable materials include reinforced fibers, wood, metal, stone or polymers, including fiberglass, plastic, etc., or may also be made of high density foam or any other suitable material. Concrete strength of veneer panels may be 6,000 psi and greater, or about twice that of commonly used segmental retaining wall blocks (SRW) and four times the strength of commonly used concrete masonry units (CMU). This increased strength of the concrete increases the veneer panels resistance to detrimental weather conditions and natural forces that might affect a block more readily, thus providing the structure constructed with the veneer panels more protection from weather and other natural forces. The veneer panels 500 which are made in the mold box may all be the same or may be made of a combination of corner veneer panels and regular veneer panels. As shown in FIG. 5A, mold box 10*c*, may be configured to produce veneer panels E, F, G and H which are all regular veneer panels and veneer panels A, B, C and D which are corner veneer panels that can be used as either regular or corner veneer panels in a wall. The difference between corner veneer panels and regular veneer panels is described in more detail hereafter. It should be noted that in the construction of a corner, corner veneer panels may be needed for an aesthetically pleasing 90 degree look. It should further be noted that in the construction of walls other than at the 90 degree corners, both types of veneer panels may be used interchangeably. Therefore, both types of veneer panels are collectively referred to as veneer panels 500 when the veneer panels can be interchangeable. It should be further noted that a different texture or pattern can be imparted to each of the veneer panels of mold box 10*c* creating 8 different veneer panels in a single mold. It should further be understood that the 8 different textures of the veneer panels may each have an up and down orientation that can be randomly used when constructing a structure giving 16 random textures from a single mold box and increasing the aesthetic value of the structure.

Figure 5B:
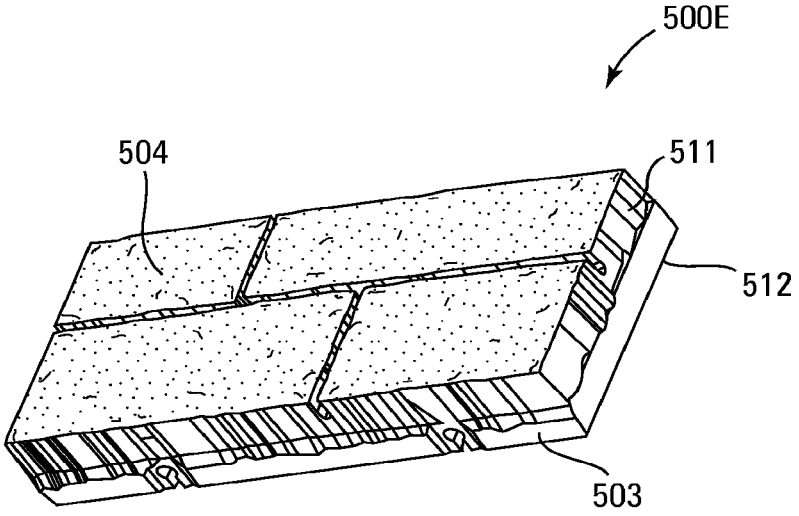
FIGS. 5B and 5C are perspective front face and top views, respectively, of an embodiment of a veneer panel of the present invention.
Figure 5C:
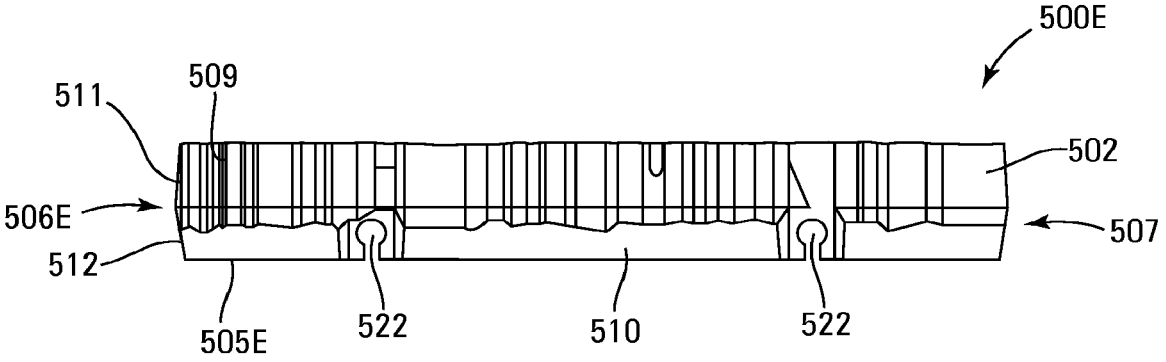

FIGS. 5B and 5C show veneer panel 500E made from mold box 10*c*. Veneer panel 500E (as well as veneer panels 500F, 500G and 500H) has parallel top surface 502 and bottom surface 503, front face 504, rear face 505E and first and second side walls 506E and 507. Front face 504 and rear face 505E each extend from top surface 502 to bottom surface 503. Top and bottom surfaces 502 and 503 have surface 509 which angles outward from front face 504, and surface 510 which angles inward from surface 509 towards back face 505E. Side surfaces 506E and 507 extend from top surface 502 to bottom surface 503 and from front face 504 to rear face 505E. Side surfaces 506E and 507 have surface 511 which angles outward from front face 504, and surface 512 which angles inward from surface 511 towards back face 505. When used in a wall, the top and bottom surfaces are interchangeable. Angled surfaces 509, 510, 511 and 512 of side surfaces 506E and 507 and top and bottom surfaces 502 and 503 give the veneer panel a more aesthetically pleasing natural stone look by allowing the stone texture to wrap around the veneer edge in a natural generally convex geometry. The angled surfaces 509, 510, 511 and 512 of side surfaces 506E and 507 and top and bottom surfaces 502 and 503 additionally function to give the front surface 504 more uniform spacing between veneer panels. Front face 504 may have any desired texture and FIGS. 5J to 5L illustrate other possible textures that may be imparted onto the front face of the veneer panel. Additionally, surfaces 509 and 511 may optionally be imparted with a surface texture as shown to improve aesthetic value of the veneer panel and give a more refined look between adjacent veneer panels in a structure. It should be noted that these textures are not limited and that any desired texture could be imparted onto the veneer panel depending upon the application and that any or all surfaces and faces of the panel may be imparted with a texture depending upon the application.

Back face 505E of veneer panel 500E has two connector channels 522 which extend a predetermined distance into the back face 505E of veneer panel 500E and accept a veneer connector or clip as described in further detail below. The spacing of the two veneer connector channels 522 are designed to align with the connector channels in the front and back faces of the blocks of the present invention. Connector channels 522 typically are oriented at the quarter points along the length of the veneer to optimize connection to the support block and to allow veneers to be sized smaller and larger than the support block face.

Figure 5D:
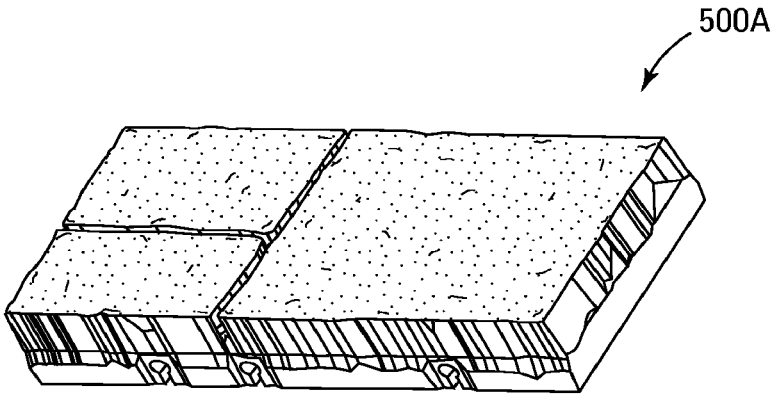
FIGS. 5D and 5E are perspective and top views, respectively, of another embodiment of a veneer panel of the present invention.
Figure 5E:
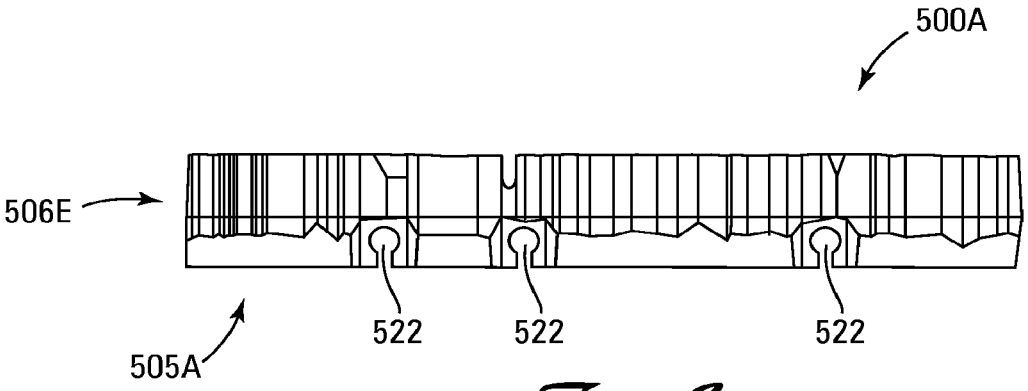

FIGS. 5D and 5E illustrate veneer panel 500A of the present invention. Corner veneer panel 500A (as well as corner veneer panels 500B, 500C and 500D) is substantially similar to veneer panel 500E except that side surface 506E is at a right angle (90 degrees) and perpendicular to both the front and back surfaces. Side surface 506E is completely textured and can be used with the corner blocks of the present invention to give the right angle corner of a structure a more aesthetically pleasing and refined look. More specifically, when forming a wall, corner veneer panel 500A will be oriented such that side surface 506E is the surface which is exposed at the corner of the wall. Back face 505A has three connector channels 522 and the spacing of the channels is designed to align with the connector channels in the front and back faces of the blocks of the present invention. Additionally the third connector channel is designed to align with the connector channel in the side surfaces of the corner blocks of the present invention, and thus veneer panel 500A can be cut to the appropriate dimension when use in conjunction with the side surface of the corner block.

Figure 5F:
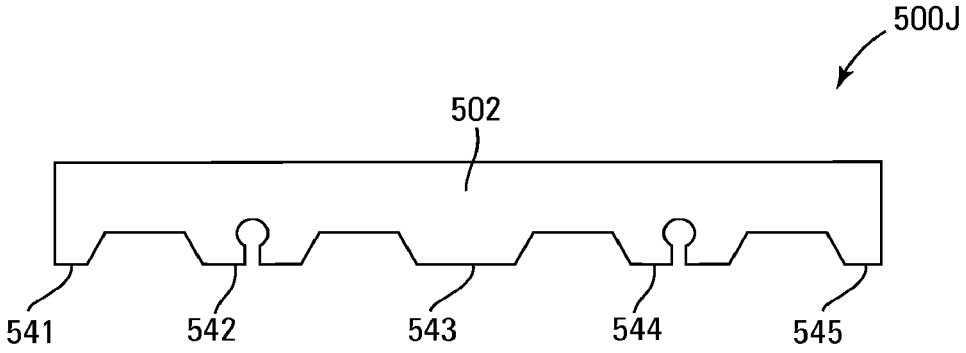
FIGS. 5F and 5G are top and back perspective views, respectively, of another embodiment of a veneer panel of the present invention.
Figure 5G:
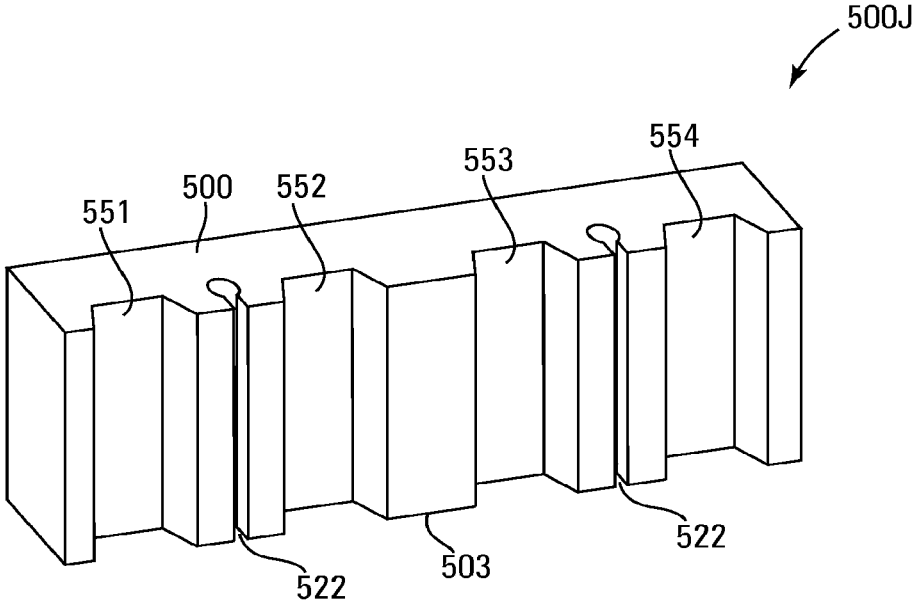

FIGS. 5F and 5G illustrate an alternative embodiment of the back face 505J of veneer panel 500. Back face 505J has projections 541, 542, 543, 544 and 545 which extend outward from the back face and create valleys 551, 552, 553 and 554. Projections 542 and 544 have connector channels 522 which extend from bottom face 503 to top face 502. The connector channels of the veneer panel are configured to align with the connector channels in the front and back faces of the blocks of the present invention and are sized to receive veneer connectors which secure the veneer panels to the wall blocks of the present invention. The valleys 551, 552, 553, and 554 are intended to lighten the weight of the veneer pieces and to allow for free flow of moisture from out behind the veneer (i.e., the flow of rainwater).

Veneer panel 500 is dimensioned to be about the same size as the front face of the blocks of the present invention. Veneer panel 500 typically has a height (i.e., the distance between surfaces 502 and 503) of about 8 inches (200 mm), a body length (i.e., the distance from side face 506 to side face 507) of about 18 inches (450 mm) and a width (i.e., the distance from front face 504 to rear face 505) of about 3 inches (75 mm). If made of materials other than concrete, the veneers typically can have thinner widths of from about 0.75 inch (19 mm) to 3 inches (75 mm). It should be noted that when veneer panels have been attached to a front or rear face of the blocks of the present invention, the combined depth of the veneer panel and the block (front surface to rear surface of assembled unit) is sized to approximate the width of a typical SRW block used in common retaining wall construction (approximately 12 inches (305 mm)). It should be further noted that the body length of the veneer panel may be slightly larger than the body length of the front face of the block for ease in accomplishing construction of a radial structure. It should be noted that the dimensions of the veneer panels and the blocks themselves are not limiting and the veneer panels and blocks can be any size depending upon the application.

Figure 5H:
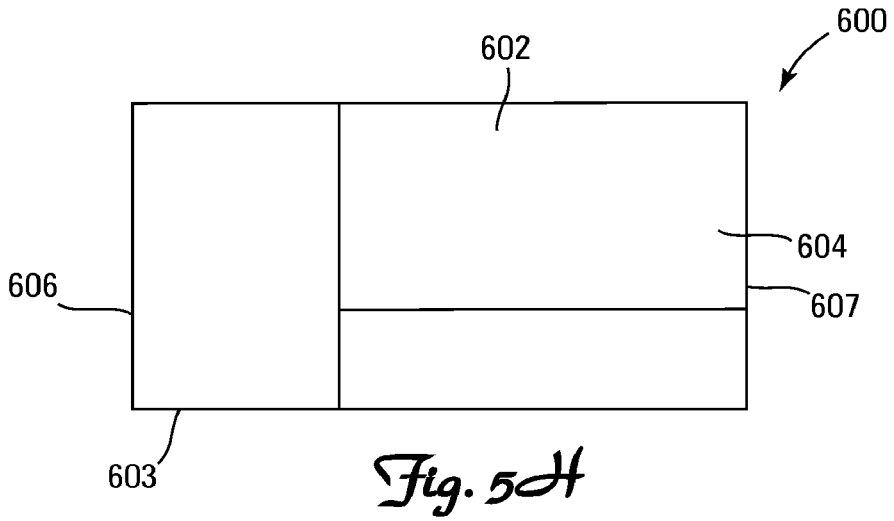
FIGS. 5H and 5I are front and top views, respectively, of another embodiment of a veneer panel of the present invention.
Figure 5I:
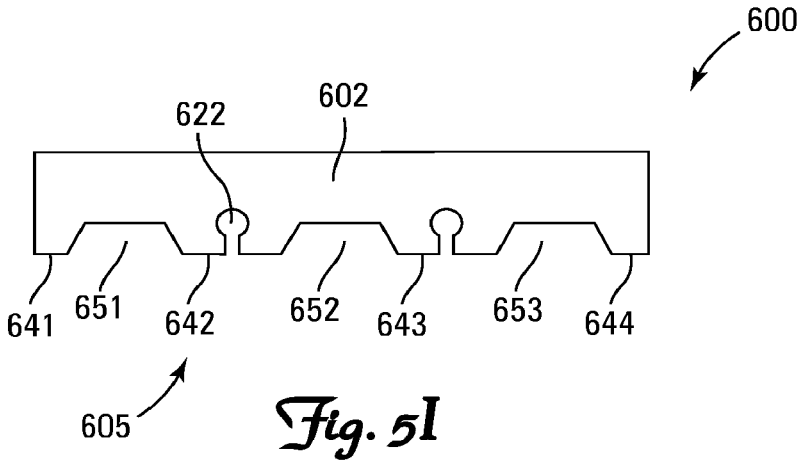
Figure 5J:
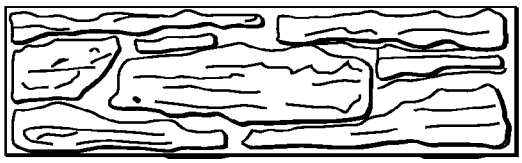
FIGS. 5J to 5L are front views of alternative textures for the front faces of the veneer panels of FIGS. 5A to 5I.
Figure 5K:
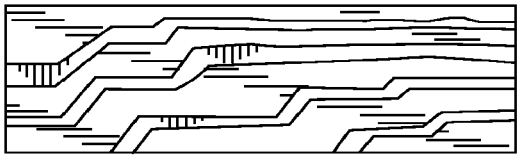
Figure 5L:
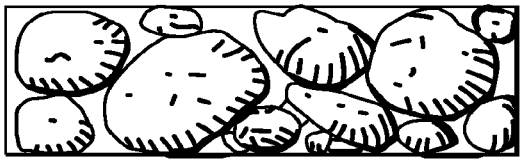

FIGS. 5H and 5I illustrate veneer panel 600 of the present invention. Veneer panel 600 is substantially similar to veneer panel 500. Back face 605 has projections 641, 642, 643, and 644 which extend outward from the back face and create valleys 651, 652, and 653. Projections 642 and 643 have connector channels 622 which extend from bottom face 603 to top face 602. The connector channels of the veneer panel are configured to align with the connector channels in the front and back faces of the blocks of the present invention and are sized to receive veneer connectors which secure the veneer panels to the wall blocks of the present invention.

Veneer panel 600 is sized to have the same surface area as the back face of the blocks of the present invention. Veneer panel 600 typically has a height (i.e., the distance between surfaces 602 and 603) of about 8 inches (200 mm), a body length (i.e., the distance from side face 606 to side face 607) of about 18 inches (457 mm) and a width (i.e., the distance from front face 604 to rear face 605) of about 3 inches (75 mm). It should be noted that the size and shape of the veneer panels are not limiting and any size or shape could be employed depending upon the application.

Figure 6A:
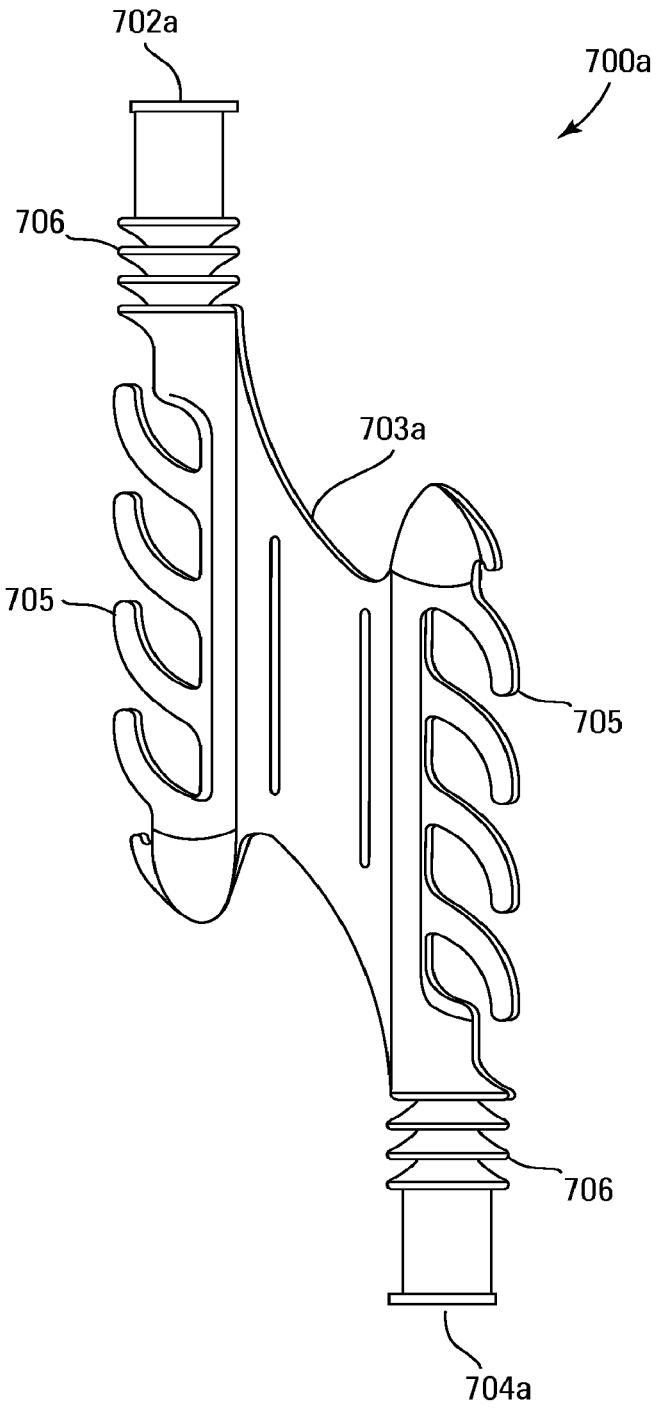
FIG. 6A is a perspective view of a veneer connector of the present invention.
Figure 6B:
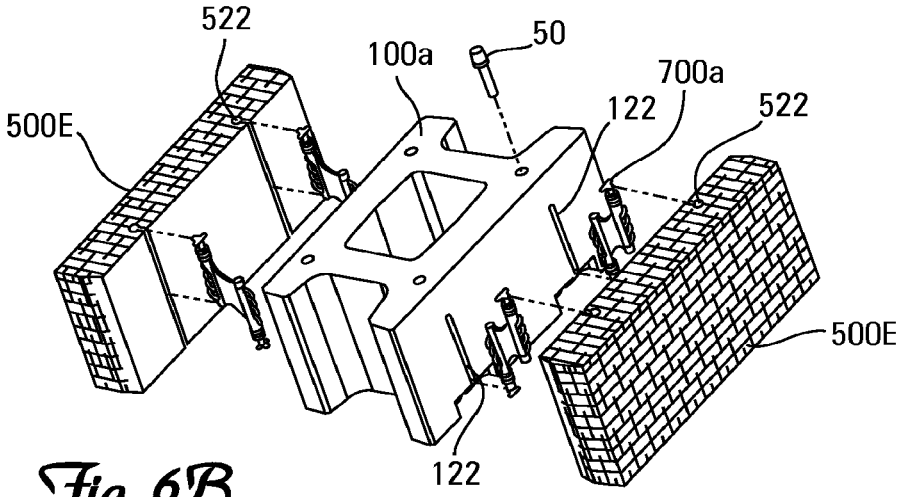
FIGS. 6B to 6D are perspective views of the veneer connector of FIG. 6A used in the wall system of the present invention.
Figure 6C:
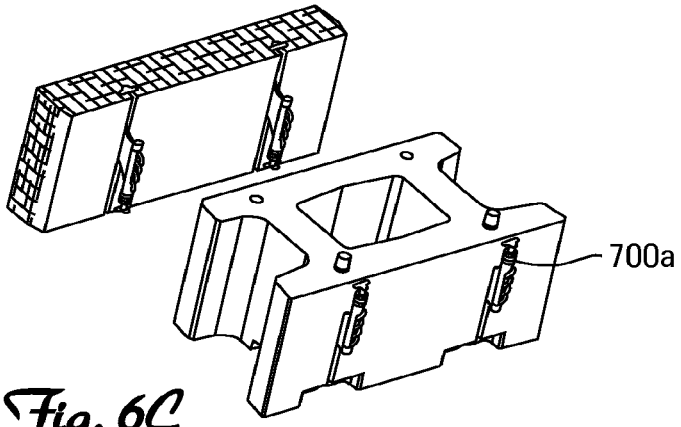
Figure 6D:
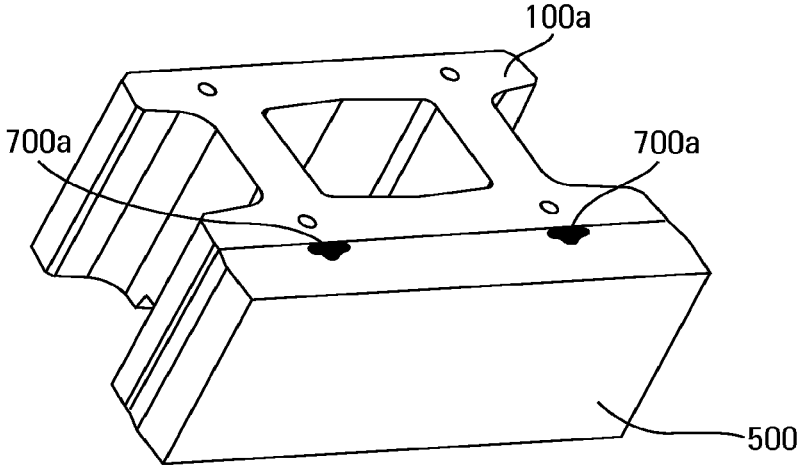
Figure 6E:
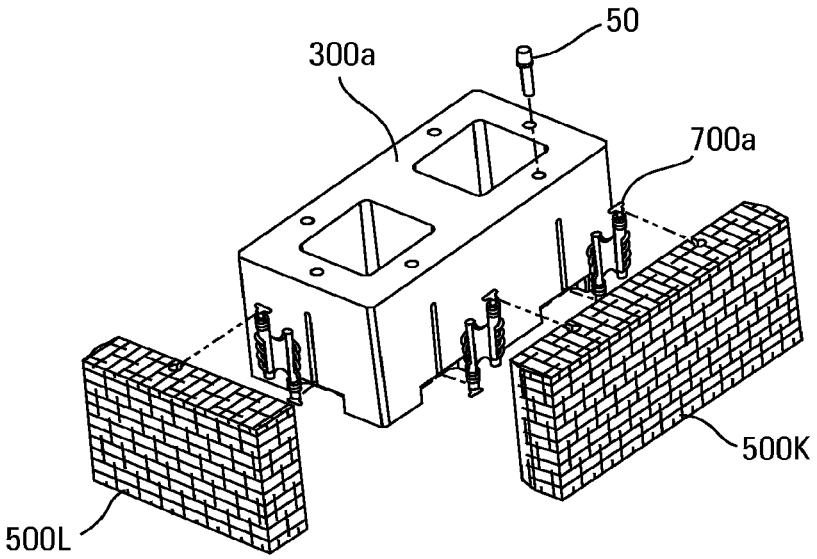
FIGS. 6E and 6F are perspective and top views of the veneer connector of FIG. 6A used in a corner block of the wall system of the present invention.
Figure 6F:
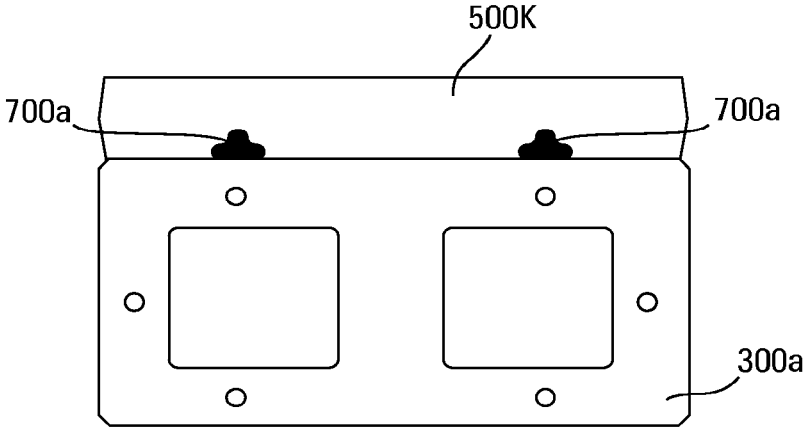

FIGS. 6A to 6F illustrate an embodiment of a veneer connector or clip 700*a* of the present invention and various examples of how the veneer clip can be attached to veneer panels and blocks of the present invention. Veneer clip 700*a* may be made of an injection molded plastic or any other suitable material. Veneer clip has shaft 702*a* connected to shaft 704*a* by bridge 703*a*. Shafts 702*a* and 704*a* have vertical friction ribs 705 and horizontal friction ribs 706 which help to secure the veneer clip into the connector channels of the veneer panels and faces of the blocks by abrading or compressing as they are slid into the connector channel. As can be seen in the exploded view in FIG. 6B veneer clips are received and secured in connector channels 122 of block 100*a* and in connector channels 522 of veneer panel 500E. In this manner veneer panels may be attached to both the front and rear faces of the blocks, as shown. As best seen in FIG. 6C, veneer clip 700*a* may be first placed into the connector channels of the block and then inserted into the connector channels of the veneer panels or may be first placed into the connector channels of the veneer panels and then inserted into the connector channels of the block, securing the veneer panel to the block. As shown in FIG. 6D, the bridge of the veneer clip is sized to optimize the connection of the veneer panel to the block with as little space as possible to allow for the most secure fit. However, in some applications it may be desirable to allow the bridge of the veneer clip a larger width so that some space is maintained between the attached veneer panel and the face of the block so that any moisture or water that accumulates in between the veneer panel and the face of the block is allowed to flow freely down and out of the space so it does not get trapped. The trapping of water, especially in colder climates, can lead to the water freezing and possibly loosening or dislodging the veneer panel from the block. An alternative to the added spacing is to provide a surface of the veneer or block with an uneven, ribbed, or fluted surface. This will break the adhesion bond of the water and avoid capillary action between the two unit surfaces and allow a channel for the water to come out. FIGS. 6E and 6F show the connector clip 700*a* used to connect veneer panels to a corner block 300*a*. FIG. 6E is an exploded view which shows a regular veneer panel 500K and a corner veneer panel 500L connected to corner block 300*a*. Veneer panel 500L has been cut to match the size of side face 306.

Figure 6G:
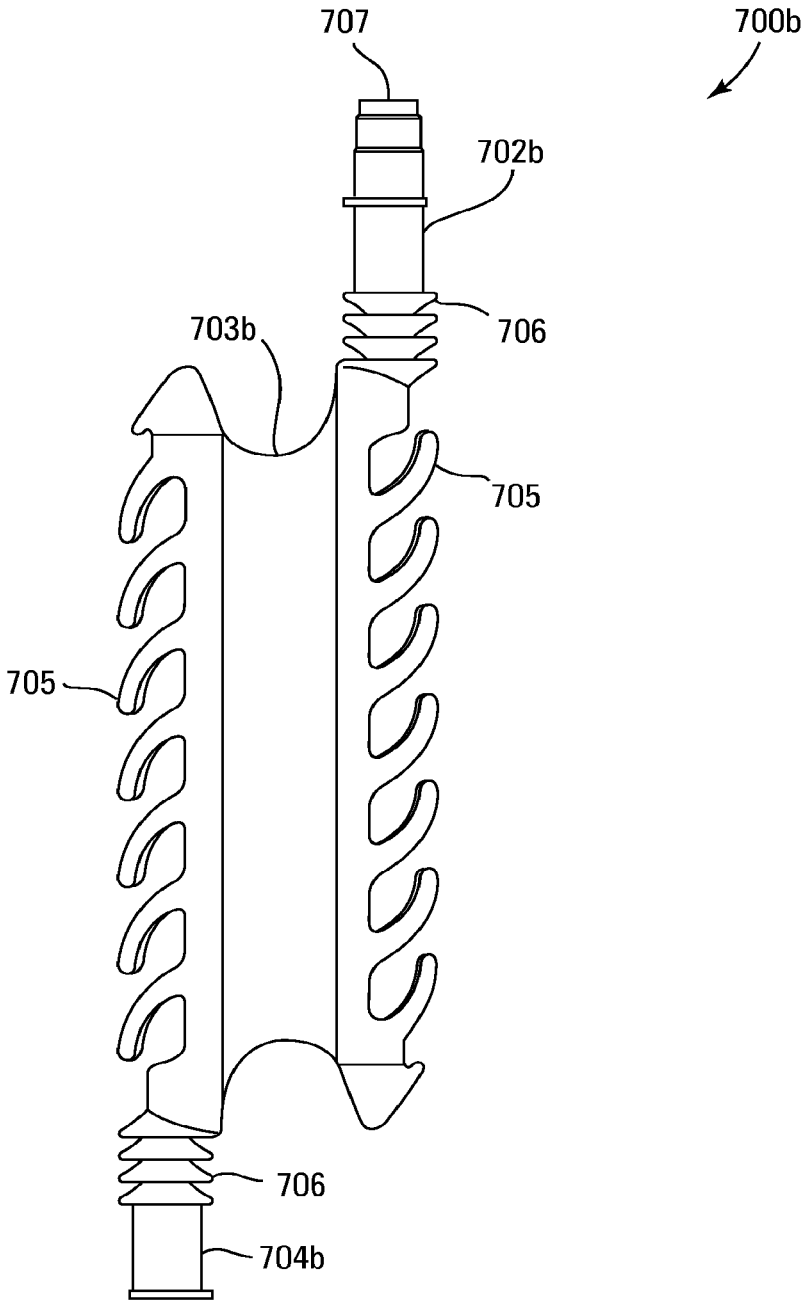
FIG. 6G is a perspective view of another embodiment of a veneer connector of the present invention.
Figure 6H:
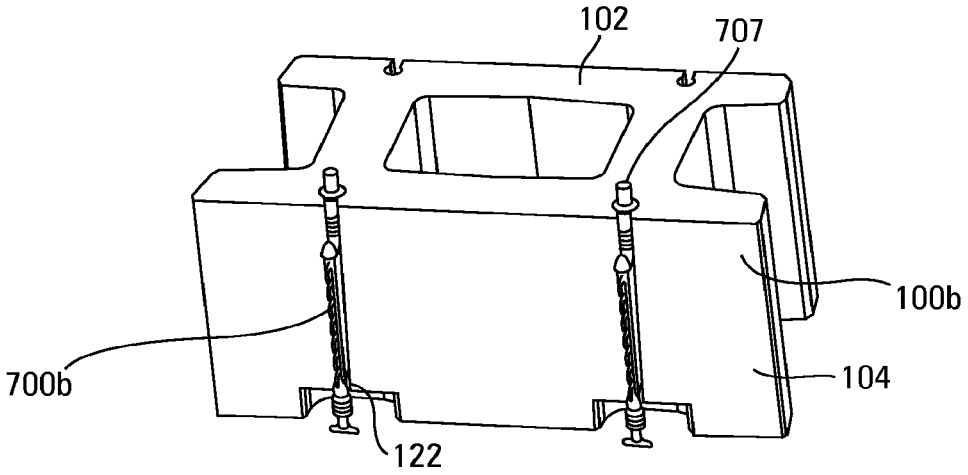
FIGS. 6H and 6I are perspective views of the veneer connector of FIG. 6G used in the wall system of the present invention.
Figure 6I:
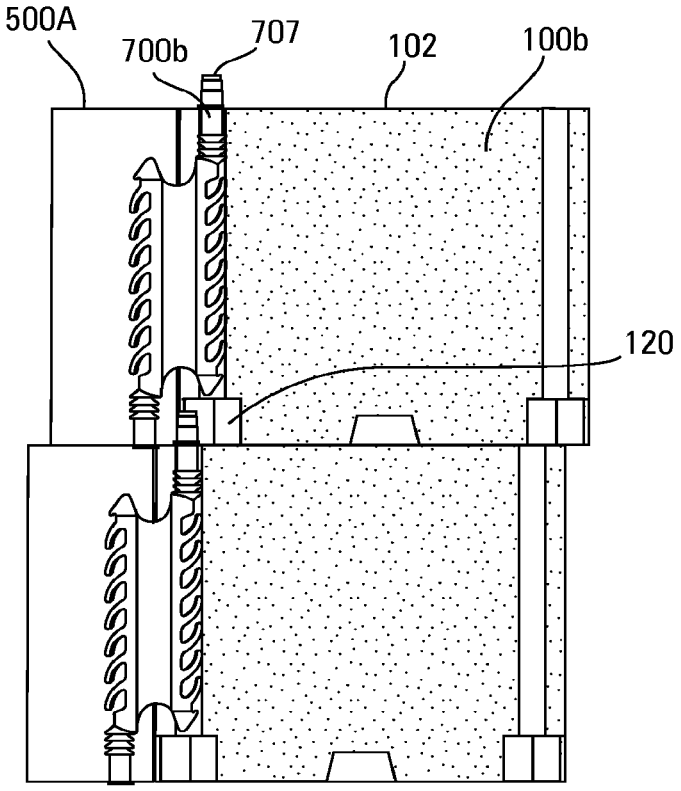

FIG. 6G illustrates a different embodiment of the veneer clip of the present invention. Veneer clip 700*b* has shaft 702*b* attached to shaft 704*b* by bridge 703*b*. Shafts 702*b* and 704*b* have vertical friction ribs 705 and horizontal friction ribs 706 which help secure the veneer clips into the connector channels of the block (front face 104 of block 100*b* in FIGS. 6H and 6I) and into the connector channels of the veneer panel (veneer panel 500A in FIG. 6I) connecting and securing the veneer panel to the block. Shaft 702*b* has projection 707 which extends above the top face of the block as seen in FIG. 6H when veneer clip 700*b* is received in receiving channel 122 of block 100*b*. With projection 707 extending above top surface 102 of block 100*b* in a first course of blocks it may be received into receiving pocket 120 of a block 100*b* in the upper adjacent course of blocks. Projection 707 thus acts like an interlocking pin which helps to secure successive and adjacent courses of block to one another, and may also be used to connect geogrid to the structural wall block element. Veneer clip 700*b* may be used as the sole means of connecting adjacent courses of blocks together as the wall is built or may be used in combination with pins 50 to connect adjacent courses of blocks depending on the requirements of the wall.

Figure 6J:
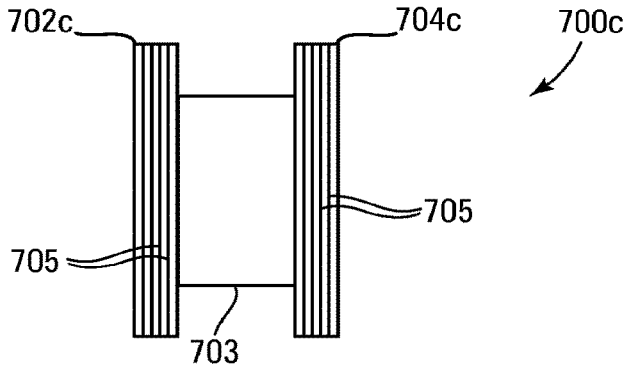
FIG. 6J is a front view of another embodiment of a veneer connector of the present invention.
Figure 6K:
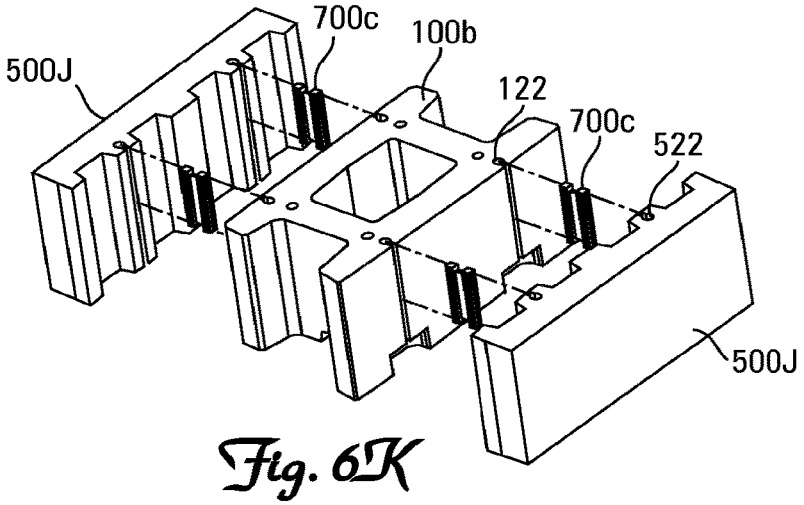
FIG. 6K is a perspective view of the veneer connector of FIG. 6J used in the wall system of the present invention.
Figure 6L:
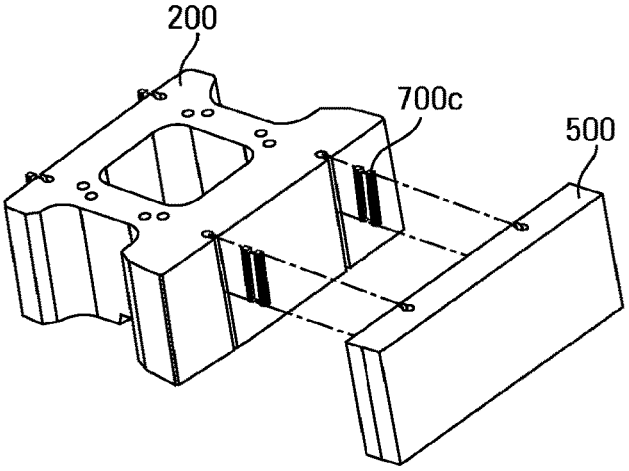
FIG. 6L is a perspective view of the veneer connector of FIG. 6J used in the wall system of the present invention.
Figure 6M:
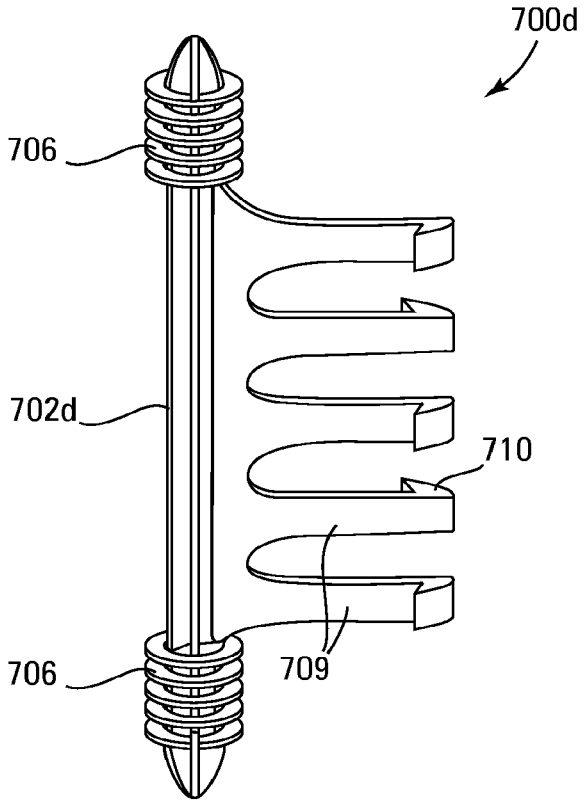

FIGS. 6J to 6L illustrate another embodiment of a veneer connector or clip 700*c* of the present invention. Veneer clip 700*c* may be made of an injection molded plastic or any other suitable material. Veneer clip has shaft 702*c* connected to shaft 704*c* by bridge 703*c*. Shafts 702*c* and 704*c* have vertical friction ribs 705 which help to secure the veneer clip into the connector channels of the veneer panels and faces of the blocks. As can be seen in the exploded view in FIG. 6K veneer clips are received and secured in connector channels 122 of block 100*b* and in connector channels 522 of veneer panel 500J. Veneer clip 700*c* may be first placed into the connector channels of the block and then inserted into the connector channels of the veneer panels or may be first placed into the connector channels of the veneer panels and then inserted into the connector channels of the block, securing the veneer panel to the block. The bridge of the veneer clip is sized to optimize the connection of the veneer panel to the block with as little space as possible to allow for the most secure fit. The valleys of the back face of veneer panel 500J allow a width between the face of the block and the veneer panel so that any moisture or water that accumulates in between the veneer panel and the face of the block is allowed to flow freely down and out of the space so it does not get trapped. The trapping of water, especially in colder climates, can lead to the water freezing and possibly loosening or dislodging the veneer panel from the block. The valleys of the back face of panel 500J also reduce the weight of the veneer panel and reduce the cost of manufacturing because less material is used to form the veneer panel.

FIG. 6L illustrates clip 700*c* used in combination with veneer panel 500 and block 200.

Figure 6N:
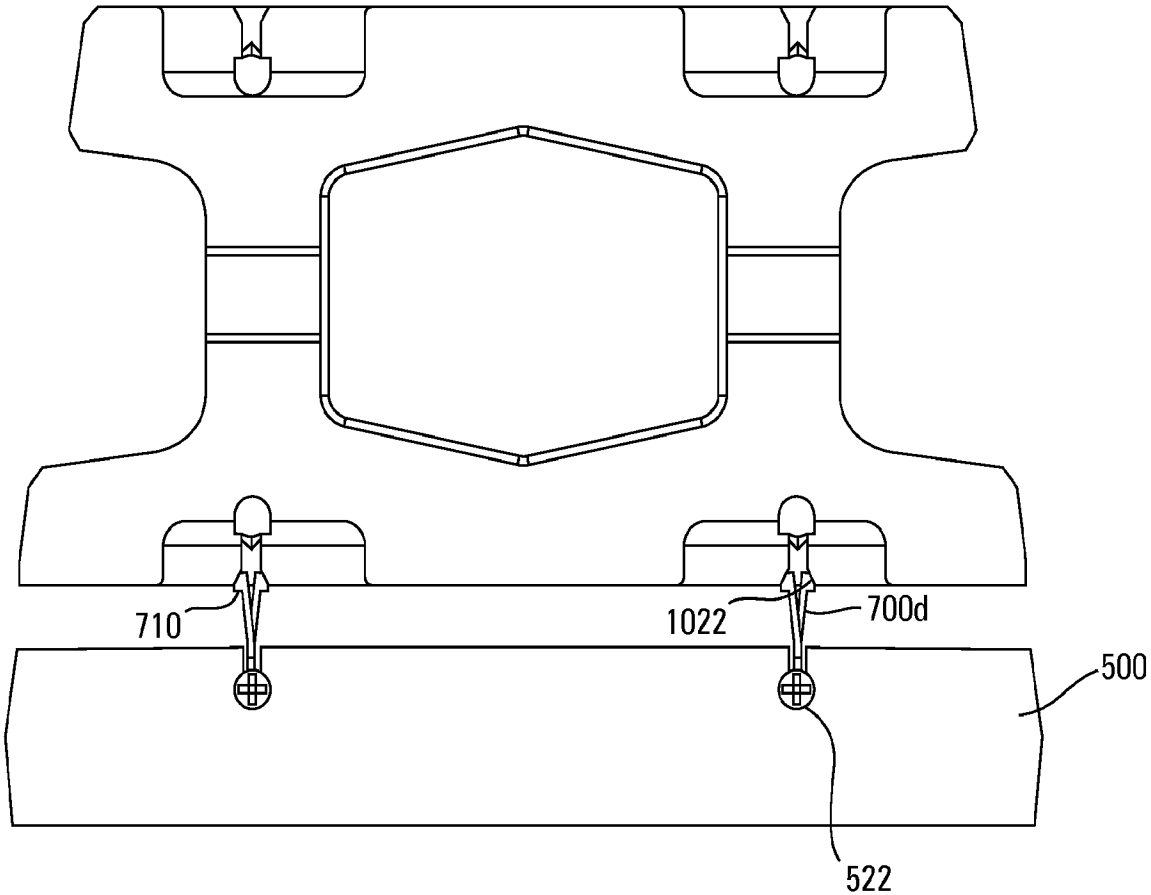
Figure 60:
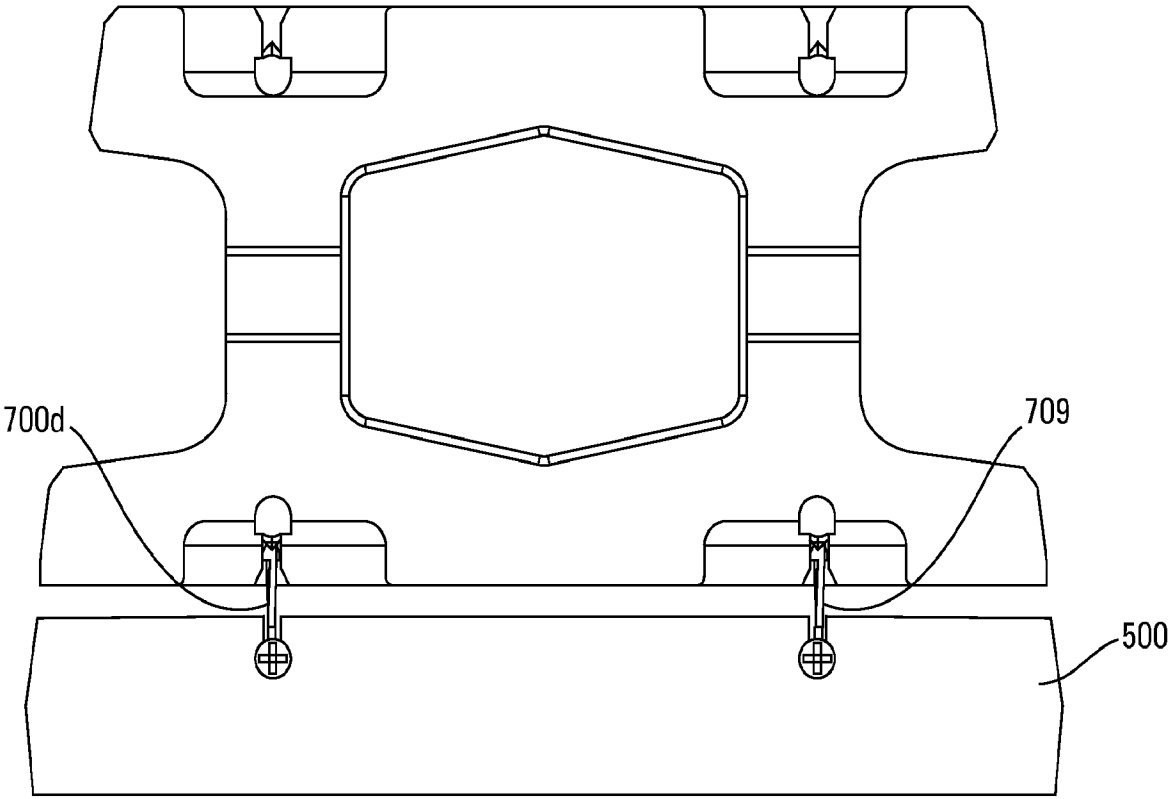
Figure 65P:
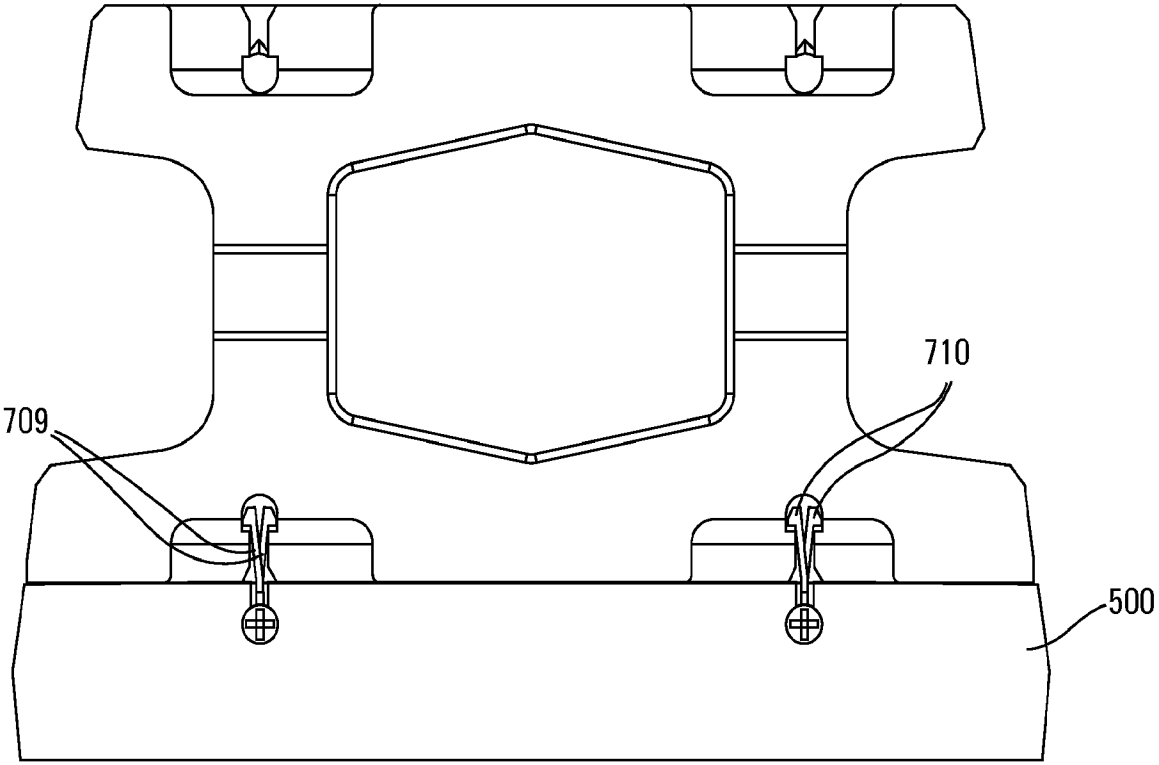

FIGS. 6M to 6P illustrate another embodiment of a veneer connector or clip 700 of the present invention. Veneer clip 700*d* may be made of an injection molded plastic or any other suitable material. Veneer clip has shaft 702*d* connected to bifurcated horizontal prongs 709. Shaft 702*d* has friction ribs 706 which help to secure the veneer clip into the connector channels of the veneer panels. FIGS. 6N to 6P illustrate veneer clip 700*d* with shaft 702*d* already inserted into connector channel 522 of veneer panel 500. The bifurcated horizontal prongs 709 of veneer clip 700*d* are inserted into an angled connector channel embodiment of the block face. As the bifurcated horizontal prongs enter the angled connector channel 1022, the prongs compress as they enter the narrowing area of the connector channel. Once the bifurcated prongs are inserted completely through the narrowing portion, the connector channel widens and the bifurcated prongs expand, securing the clip and veneer panel to the face of the block. Tabs 710 on bifurcated prongs 709 add additional connectivity by interlocking the prongs into the connector channel and not allowing them to be pulled out back through the connector channel once inserted. In this manner the structural wall can first be built without the placement of any veneer panels or veneer clips. A major benefit to using this type of connector is that the structural wall can be built with the wall blocks being built into the wall, without having veneer panels attached. Veneer panels can be added at any point during the wall assembly. This can help in scheduling of materials at the job site, protection of the veneer elements from general construction damage, or to make building the structural wall an easier job due to lightening the weight of the wall blocks being placed into the wall. Veneer clips may be slid into the connector channel of the veneer panel and then the veneer panel and clip can be snapped into the connector channels on the face of the wall. It should be noted that the shaft of veneer clip could be received in the connector channel of the wall block and that the bifurcated prongs could be received onto the connector channel of the veneer panel.

Non-bifurcated veneer connectors can be added on to the wall blocks without veneer panels to lighten the weight of the blocks during the wall construction. The veneer panels can then be added on to the wall blocks of the wall by slipping the veneers down over the top ends of the veneer clips at any point during construction.

Figure 6Q:
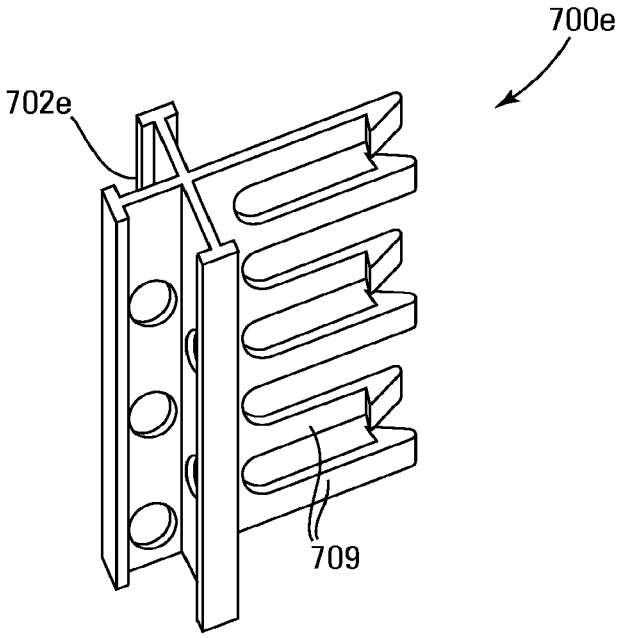
FIGS. 6Q and 6R are perspective and top views, respectively, of another embodiment of a veneer connector of the present invention.
Figure 6R:
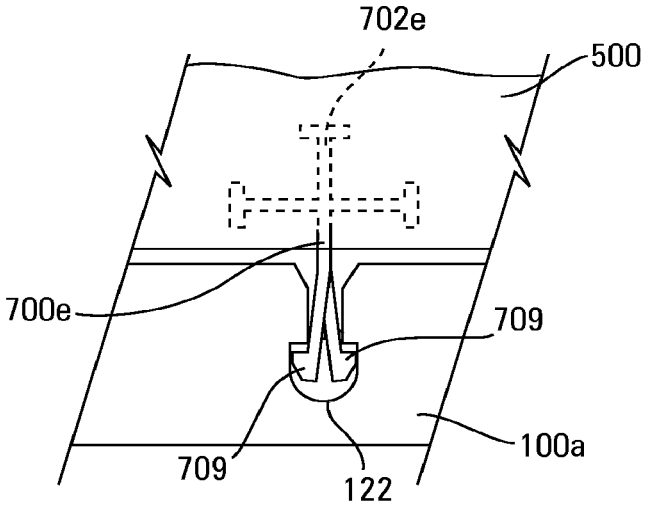

FIGS. 6Q and 6R illustrate another embodiment of a veneer connector or clip 700*e* of the present invention. Veneer clip 700*e* may be made of an injection molded plastic or any other suitable material. Veneer clip has shaft 702*e* connected to bifurcated horizontal prongs 709. Shaft 702*e* is designed to be molded into either the face of the block or the back face of the veneer panel, leaving only the bifurcated horizontal prongs exposed. Bifurcated horizontal prongs can then be received into the corresponding connector channels of the block faces or veneer panel, depending upon the application. The compression of the prongs as the prongs are first received in the narrower area of the connector channel and expand as the channel widens serves to secure the prongs into the connector channel, i.e., securing the connector and veneer panel to the face of the block. In this manner the structural wall can first be built without the placement of any veneer panels or veneer clips. After the structural wall has been completed veneer clips may be slid into the connector channel of the veneer panel and then the veneer panel and clip can be snapped into the connector channels on the face of the wall.

Figure 7A:
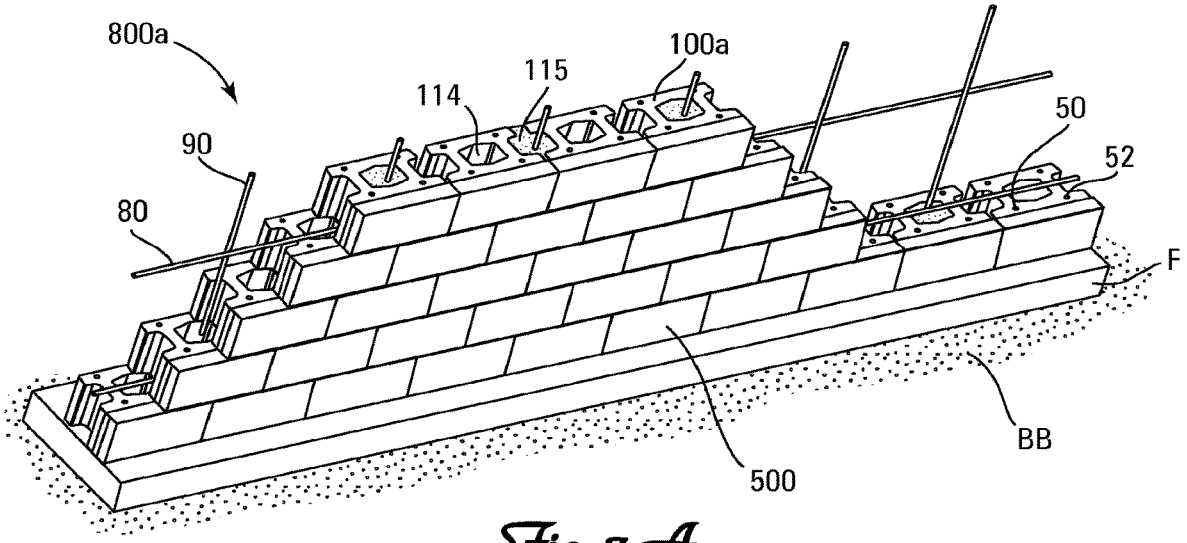
FIG. 7A is a perspective view of a wall formed from a wall system of the present invention.

FIG. 7A illustrates straight wall 800*a* constructed from the blocks 100*a* and veneer panels 500. Generally, when constructing a wall, a trench is excavated to a pre-selected depth and backfilled with a level base BB of granular material such as crushed stone or sand. A concrete structural footer F is then poured and allowed to set. A base layer is then placed and leveled onto the footer. The blocks are placed side by side with bottom face 103 facing downward and front face 104 facing outward with the next adjacent block 100*a* following the same block orientation with front face 104 facing outward in each course of block. Once the base layer is laid, veneer clips 700*a* are inserted into the connector channels of the front faces of the blocks facing outward (exposed faces of the blocks) in the base layer of the wall. Vertical friction ribs 705 and horizontal friction ribs 706 of veneer clip 700*a* engage the connector channels and securely and tightly lodge the clip into the channel. It should be noted that both sides of the wall/base layer may be outward facing or exposed. After insertion of the clips 700*a* into the front faces 104 of the wall blocks, the remaining exposed shafts of the veneer clips 700*a* are inserted into the receiving channels 522 of veneer panels 500. Veneer panels 500 receive the exposed shafts of the clips that were placed in the front face 104 of blocks 100*a*, securely attaching the veneer panel to the block. It should be noted that if the base level is below grade the veneer panels and clips need not be utilized until there is a subsequent course of the wall that is visible. It should further be noted that the blocks may have the veneer panels attached to the block before the blocks are used in construction of the structure, in this manner the block and veneer panel come as one structure to the construction site or could be assembled at the site before being placed, the block and veneer panel being approximately the same size as a common wall block of the art, with construction of the structure proceeding like that of a common sized wall block. It should also be noted that the wall could be constructed to the desired height with the clips inserted as the wall is built and then the veneer panels could be attached to the exposed clips of the wall after the structure has been built to the desired height.

Horizontal reinforcing member 80 may then be laid upon the base course of blocks and pins 50 may be placed in the pin holes of the top surface 102 of block 100*a* of the base course. Vertical reinforcing members 90 may be inserted into cores 114 of block 100*a* or through the side void opening 115 created by the placement of two adjacent blocks 100*a*. Alternatively, vertical reinforcing members 90 could have been placed into the footer while the concrete was setting, securing the vertical reinforcing members to the footer and adding the ability to resist overturning loads such as wind and impacts. When building an internally reinforced wall the pins could be left out and the concrete and reinforcing members will connect all the blocks together. The receiving channel 130 in the bottom face 103 of blocks 100*a* of the subsequent adjacent course receive and secure the horizontal reinforcing member 80 giving the structure increased strength and durability. The pin heads 52 from pinholes of the base layer are received and secured in the receiving pockets 120 *a/b/c* and/or 120*d* of the subsequent adjacent course of blocks 100*a*. Once the next course is laid the veneer clips 700*a* and veneer panels 500 are attached and secured to the blocks 100*a* of the course (if the panels have not already been secured to the desired block face) and then subsequent courses of the wall are laid, including the placement of interlocking pins and horizontal and vertical reinforcing members, until the desired height of the wall is achieved. Once the desired height has been reached concrete may be poured through the core and side void openings to further strengthen the structure and a capping layer may be utilized for a more finished and aesthetically pleasing look. It should be noted that wall blocks 100*b* and 200 may also be used as described in the construction of such a wall with veneer panels 500.

Figure 7B:
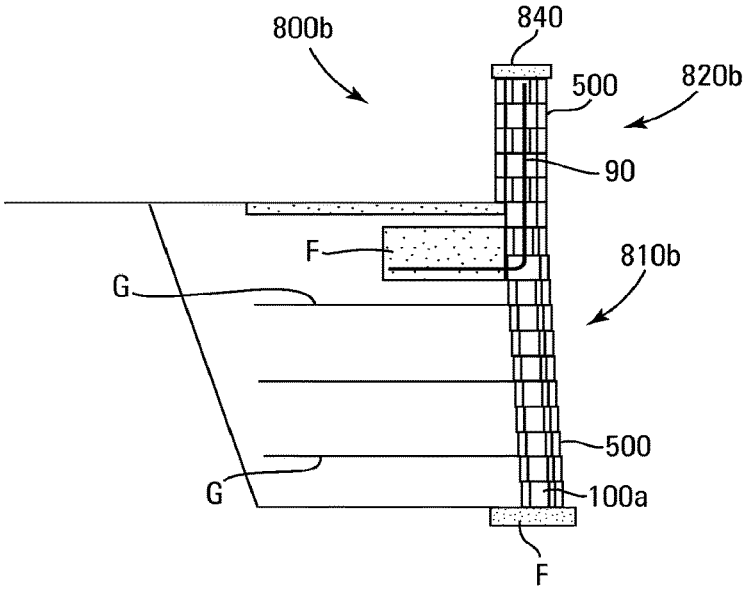
FIG. 7B is a cross-sectional view of a parapet wall and lower retaining wall constructed from the wall system of the present invention.

FIG. 7B illustrates a cross section of a parapet retaining wall 800*b* made with block 100*a* as shown in FIGS. 1A to 1F. Retaining wall courses 810*b* of the wall 800*b* are laid so that front face 104 is facing outward or is exposed allowing for the set back shown due to the pinning system of the present invention whereby the head of a pin of a lower course is received in the setback receiving pockets 120*a* and 120*b* of the upper adjacent course of block. Retaining wall courses of wall 800*b* may also utilize geogrid G which can be received and secured in the receiving channel 130 of bottom surface 103 of wall block 100*a* or can be secured to the pinning system of the retaining wall. Cantilever footer F is poured near the top of the retaining wall courses and vertical reinforcing members 90 are allowed to set into footer F.

Parapet wall courses 820*b* of wall 800*b* can be laid with front face 104 facing the same way as blocks 100*a* of retaining wall courses 810*b* or may be placed with back face 105 facing the same way as the blocks of retaining wall courses 810*b* because both surfaces are exposed and covered with veneer panels 500. In this manner, the orientation of the blocks in parapet wall courses 820*b* is not as important as the placement of the pins so that the head 52 of the pin is received into receiving pockets 120*c* and 120*d* to allow for no setback. If internally reinforced like the parapet wall shown, the builder can choose to eliminate the course to course connecting pins in the parapet section and rely on the internal reinforcing concrete grout and reinforcing members for block connection. Capping layer 840 gives parapet retaining wall 800*b* an aesthetically pleasing finished look.

Figure 7C:
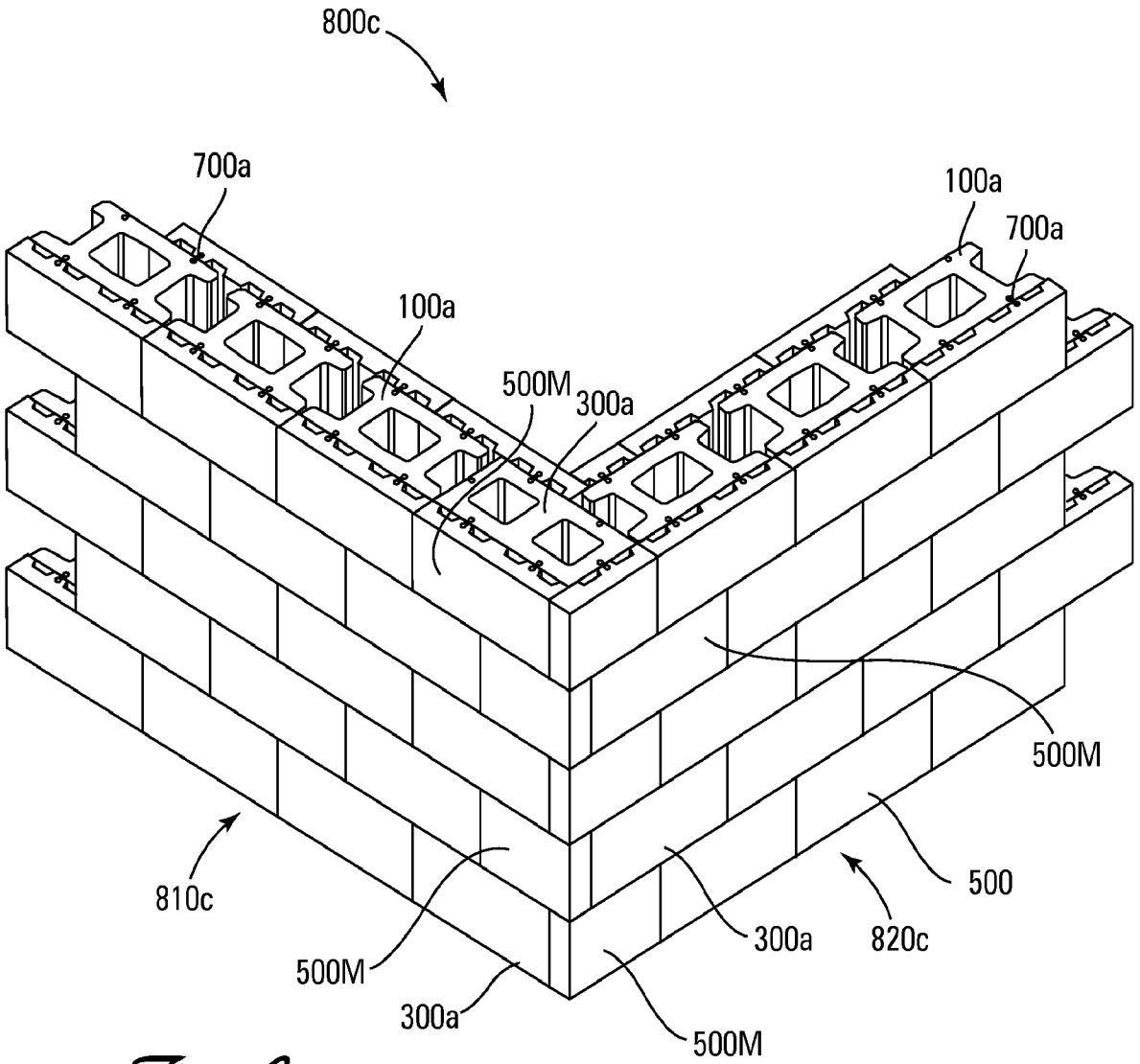
FIG. 7C is a perspective view of a double sided corner wall constructed from the wall system of the present invention.

FIG. 7C illustrates a double sided wall 800*c* with a 90 degree corner formed with wall blocks 100*a* and corner block 300*a* and veneer panels 500 of the present invention. This wall is constructed utilizing the pinning system of the present invention whereby no setback is allowed and thus the pin head 52 of a lower course of blocks is received in receiving pockets 120*c* and 120*d* of the upper adjacent course of block 100*a*. Wall 800*c* is constructed with all of front faces 104 of block 100*a* being orientated towards the outside of corner wall 800*c* while all of the back faces 105 are orientated towards the inside of the corner wall. Back faces 105 will have a space between each adjacent back face 105 in a course of blocks. Corner block 300*a* is laid with front face 304 being utilized in wall segment 810*c* in the base layer and then in every other layer above the base layer. On the next adjacent course, corner block 300*a* is laid with front face 304 being utilized in wall segment 820*c*. Veneer panels 500 may be secured to the front face 104 of the wall blocks as described above with each individual veneer panel 500 being attached to a front face 104 of each block 100*a*. Corner veneer panel 500M may be the same dimension as the area of the front face (or back face) of corner block 300*a* and is attached to the front face 304 of corner block 300*b* on the outside of the corner wall. Side face 306 or 307 of corner block 300*a* that is exposed to the outside of wall 800*c* also utilizes corner veneer panel 500M that is connected with veneer clip 700*a* and is either field cut to the proper dimensional requirement as needed or may be pre-formed as a second optional veneer panel for use in constructing the wall with a 90 degree corner.

Veneer panels 500 may be attached to the back faces 105 of the inside corner wall in an off-set manner whereby a veneer clip 700*a* from the back face 105 of one wall block 100*a* and one veneer clip 700*a* from the back face 105 of a second adjacent block 100*a* may each engage the connector channels 522 from the same veneer panel. Back face 305 (which is the same size and area as that of front face 304) of corner block 300*a* of the inside surface of the corner wall 800*c* may be attached to corner veneer panel 500A and the same veneer panel 500M may be attached to the back face 105 of an adjacent block 100. It should be noted that the positioning of the veneer panels on the wall is not limiting and that an individual veneer panel may be attached to two adjacent blocks on the outside of wall 800*c* and that one veneer panel 500 may be utilized for each individual back face 105 of the inside surface of corner wall 800*c* as well, depending upon the application.

Figure 7D:
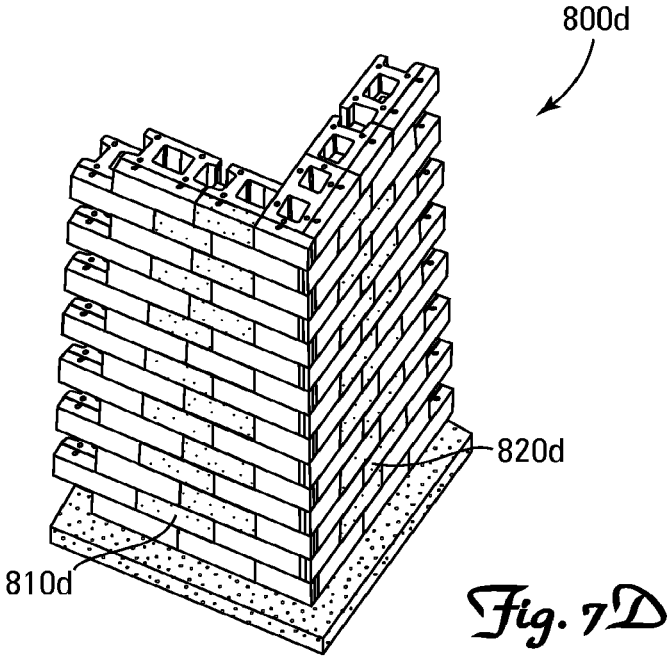
FIGS. 7D and 7E are perspective views of a 90 degree corner wall showing corner units and common units built with veneers.
Figure 7E:
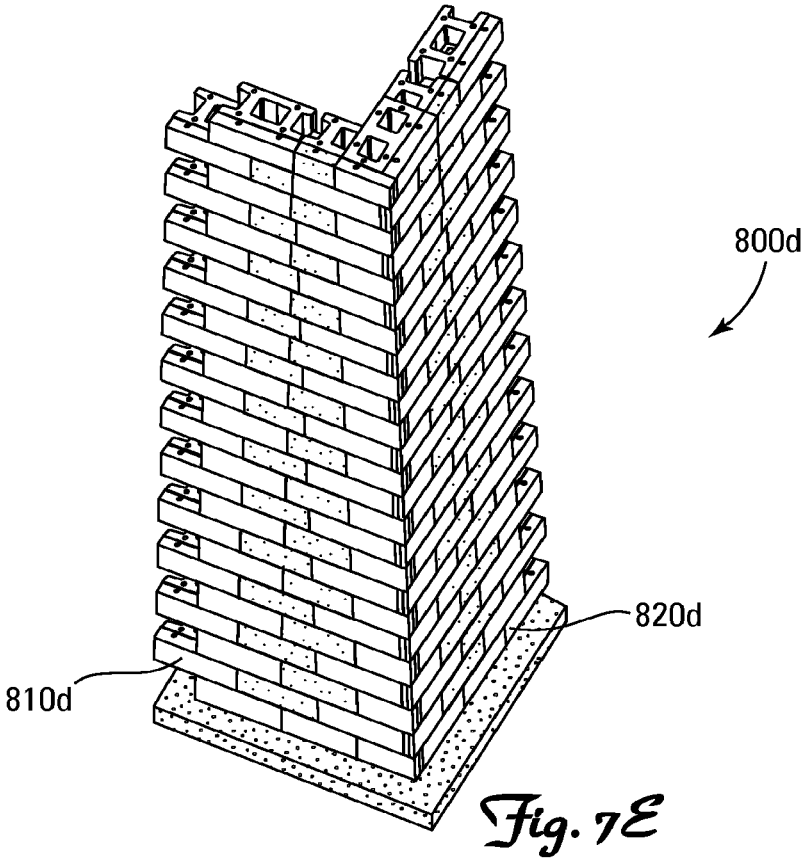

FIGS. 7D and 7E illustrate a single sided wall 800*d* with a 90 degree corner formed with wall blocks 100*a* and corner block 300*a* and veneer panels 500 of the present invention. This wall is constructed utilizing the pinning system of the present invention whereby setback is allowed and thus the pin head 52 of a lower course of blocks is received in receiving pockets 120*a* and 120*b* of the upper adjacent course of block 100*a*. The setback of the wall creates a slight decrease in the length of each block course in each wall segment 810*d* and 820*d* as more and more courses are added. To counteract this decrease in course length of each wall segment, a block 100*a* from each course must be field cut to the appropriate reduced length and accordingly the veneer panel 500 that is to be attached to the field cut block must also be cut to the appropriate dimension. The field cut blocks and veneer panels are highlighted in both wall segments of FIGS. 7D and 7E.

Figure 7F:
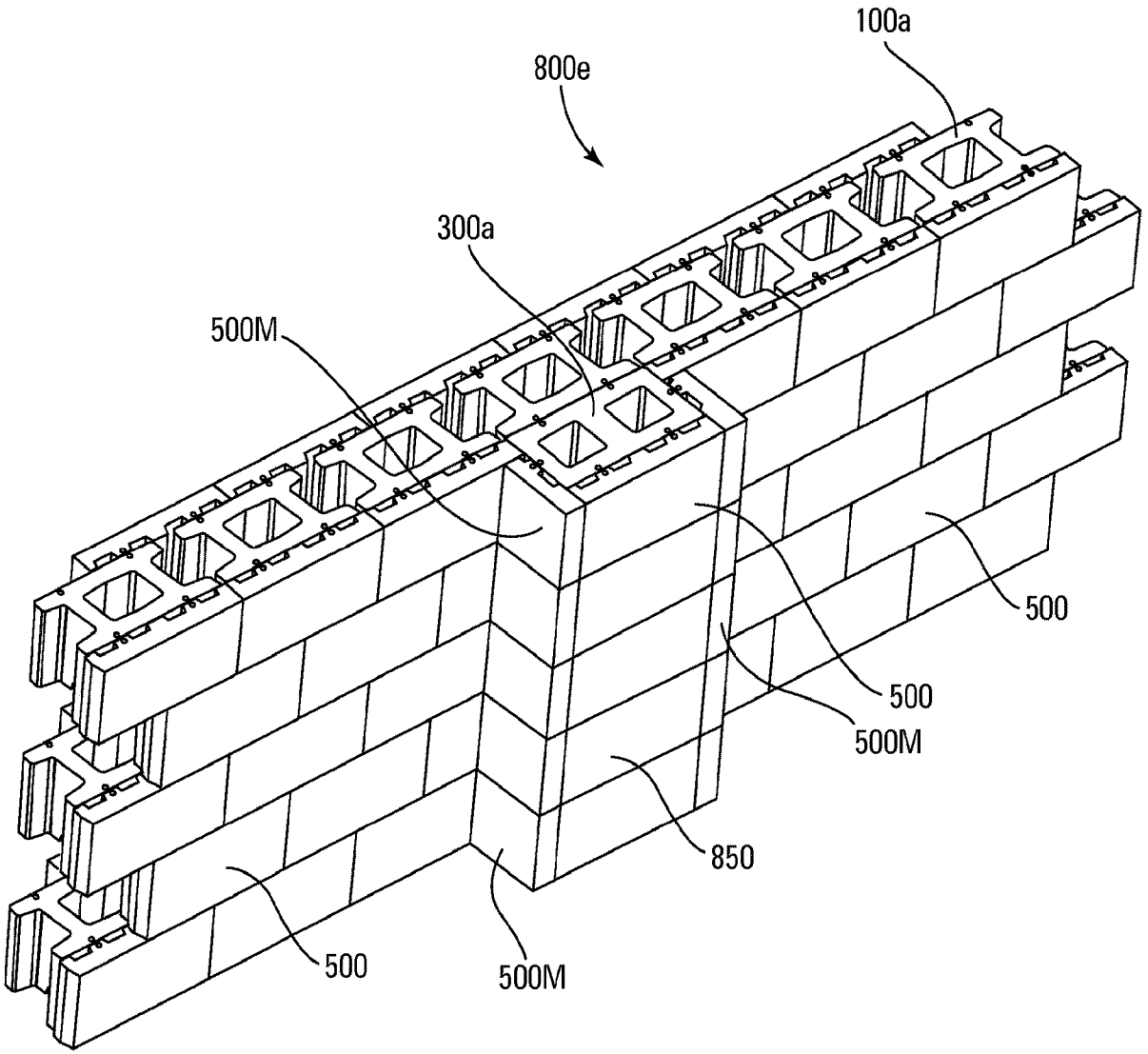
FIG. 7F is a perspective view of a double sided, free-standing pilaster wall constructed from the wall blocks of the present invention.
Figure 79:
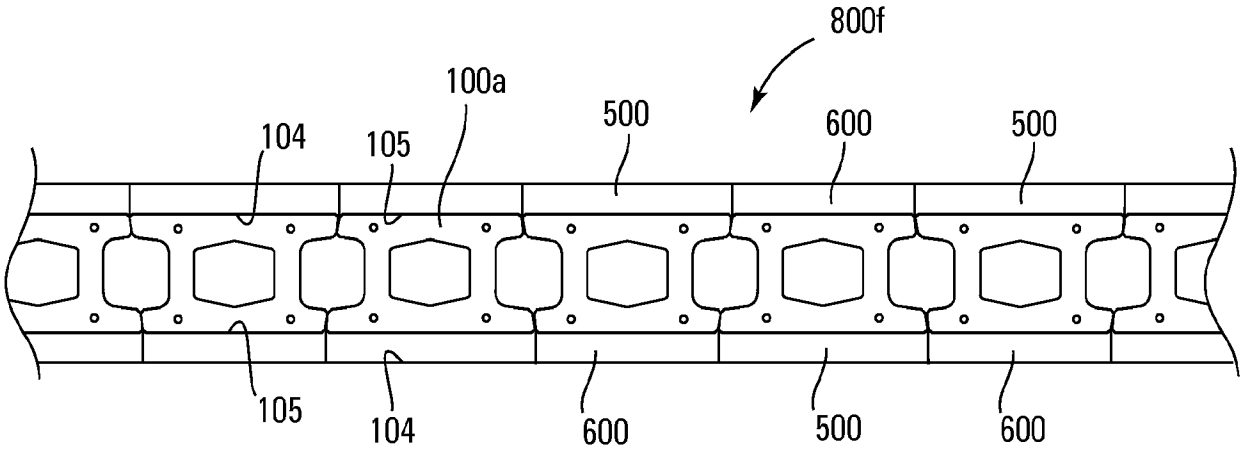

FIG. 7F illustrates a double sided, freestanding pilaster wall 800*e* formed from blocks 100*a* and 300*a* and veneer panels 500 of the present invention. Wall 800*e* is formed with all of the front faces 104 of blocks 100*a* orientated facing outward one side of the wall and all of the back faces 105 orientated facing outward the opposite side of the wall. Back faces 105 will have a space between each adjacent back face of blocks in a course. Corner block 300*a* is laid at a desired location along the wall forming pilaster 850. Veneer panels 500 may be secured to the front face 104 of the wall blocks 100*a* as described above with each individual veneer panel 500 being attached to an individual front face 104 of each block 100. Veneer panel 500 may be the same dimension as the area of the front face (or back face) of corner block 300*a* and is attached individually to the front face 304 of corner block 300*a* on a desired side of the wall forming the pilaster 850. The side face 306 or 307 of corner block 300*a* utilized in the formation of the pilaster is attached to corner veneer panel 500M that is connected with veneer clip 700*a* and is either field cut to the proper dimensional requirement as needed or may be pre-formed as a second optional veneer panel for use in constructing the pilaster wall 800*e*. Veneer panels 500 may be attached to the back faces 105 of the opposite side of the pilaster wall 800*e* in an off-set manner whereby a veneer clip 700*a* from the back face 105 of one wall block 100 and one veneer clip 700*a* from the back face 105 of a second adjacent block 100 may each engage the receiving channels 522 from the same veneer panel. It should be understood that one veneer panel 500 may be utilized for each individual back face 105 of the opposite side of wall 800*e* as well, depending upon the application. It should be further understood that the positioning of the veneer panels on the wall is not limiting and that a veneer panel may be attached to two adjacent blocks on either side of the exposed wall. It should be understood that one veneer panel 500 may be utilized for each individual back face 105 of the opposite side of wall 800*e* as well, depending upon the application. It should be also noted that the location of the pilaster is not limiting and that multiple pilasters could be placed on one or both sides of the wall being constructed.

FIG. 7G illustrates straight retaining wall 800*f* constructed from blocks 100*a* and veneer panels 500 and 600. Blocks 100*a* are placed side by side with bottom face 103 facing downward then alternating front face 104 facing outward with the next adjacent block having back face 105 facing outward in each block course. Veneer panels 500 have the same surface area as front face 104 and are attached to the exposed front face 104 of retaining wall 800*f*. Veneer panels 600 have the same surface area as back face 105 and are attached to the exposed back face 105 of retaining wall 800*f*.

Figure 7H:
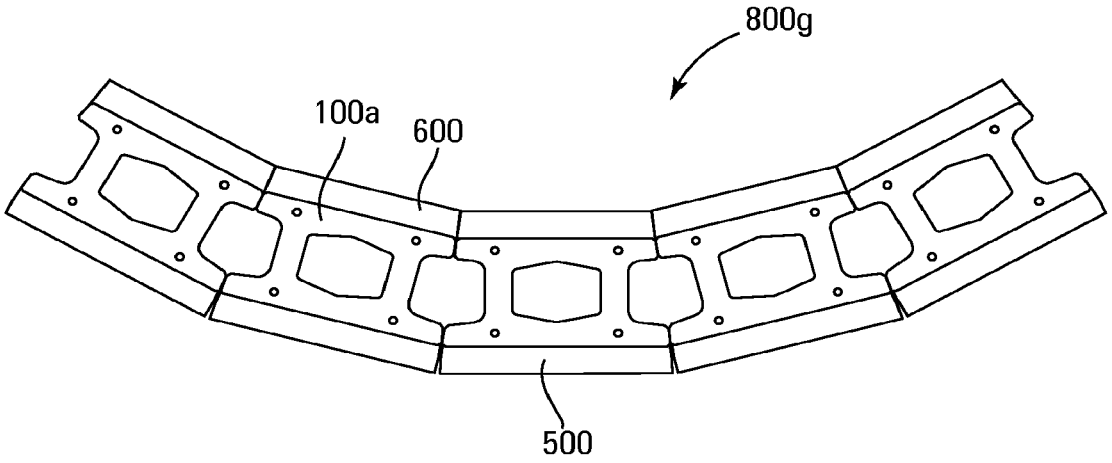
FIG. 7H is a top view of a curvilinear wall formed from the wall system of the present invention.

FIG. 7H illustrates a curvilinear wall 800*g* formed from blocks 100*a* and veneer panels 500 and 600 of the present invention. Wall 800*g* is formed with all front faces 104 of blocks 100*a* orientated facing outward one side of the wall and all back faces 105 orientated facing outward the opposite side of the wall with no space between the adjacent back faces which causes a consistent and constant radial curve to the wall. Veneer panels 500, having the same rear face dimensions as front face 104, may be secured to the front face 104 of the wall blocks 100*a* as described above with each individual veneer panel 500 being attached to an individual front face 104 of each block 100. Veneer panels 600, having the same rear face dimensions as back face 105, may be secured to the back face 105 of the wall blocks 100*a* as described above with each individual veneer panel 600 being attached to an individual back face 105 of each block 100*a*.

Figure 8A:
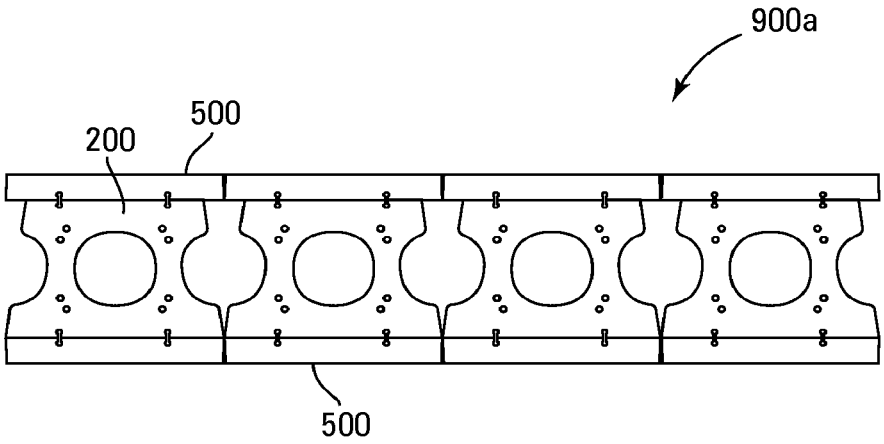
FIGS. 8A to 8C are top views of walls formed from another embodiment of a wall block and veneer panel system of the present invention.

FIG. 8A illustrates a straight wall 900*a* formed from blocks 200 and veneer panels 500. Wall 900*a* is formed with all of the front faces 204 of blocks 200 orientated facing outward one side of the wall and all of the back faces 205 orientated facing outward the opposite side of the wall. Back faces 205 will have a space between each adjacent block. Veneer panels 500 may be secured to the front face 204 of the wall blocks 200 by inserting veneer clip 700*c* into the receiving channels 222 of front faces 204 and back faces 205 with each individual veneer panel 500 being attached to an individual front face 204 and individual back face 205.

Figure 8B:
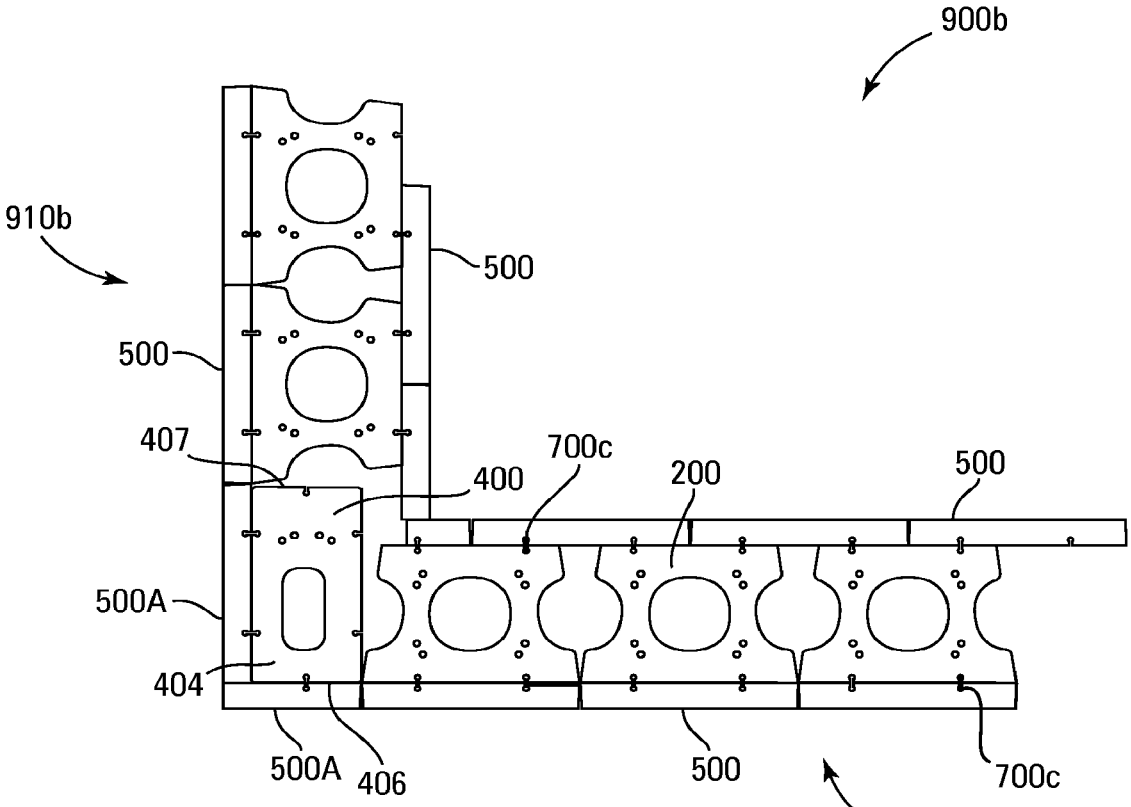

FIG. 8B illustrates a wall 900*b* with a 90 degree corner formed with wall blocks 200 and 400 and veneer panel 500 of the present invention. Wall 900*b* includes wall segments 910*a* and 910*b*. Wall 900*b* is formed with all front faces 204 of block 200 being orientated towards the outside of the wall 900*b* while all back faces 105 are orientated towards the inside (opposite) of the corner wall 900*b*. Back faces 105 will have a space between each adjacent block 200. Corner block 400 is laid with front face 404 being utilized in wall segment 910*b* in the base layer and then in every other layer above the base layer. On the next adjacent course corner block 400 is laid with front face 404 being utilized in wall segment 910*a*. Veneer panels 500 may be secured to the front face 204 of the wall blocks as described above with each individual veneer panel 500 being attached to a front face 204 of each block 200 by means of clip 700*c*. Corner veneer panel 500A may be the same dimension as the area of the front face (or back face) of corner block 400 and is attached individually to the front face 404 of corner block 400 on the outside of the corner wall 900*b*. The side face 406 or 407 of corner block 400 that is exposed to the outside of wall 900*b* has corner veneer panel 500A that is connected with veneer clip 700*c* and is either field cut to the proper dimensional requirement as needed or may be pre-formed as a second optional veneer panel for use in constructing the wall with a 90 degree corner.

Veneer panels 500 may be attached to the back faces 205 of the inside corner wall in an off-set manner as described whereby a veneer clip 700*c* from the back face 205 of one wall block 200 and one veneer clip 700*c* from the back face 205 of a second adjacent block 200 may each engage the receiving channels 522 from the same veneer panel. Corner block 400 may be attached to veneer 500 and the same veneer panel 500 may be attached to the back face 205 of an adjacent block 200. It should be noted that the positioning of the veneer panels on the wall is not limiting and that one veneer panel 500 may be utilized for each individual back face 205 of the inside corner wall 900*b* and that a veneer panel may be attached to two adjacent blocks on the outside of corner wall 900*b* as well, depending upon the application.

Figure 8C:
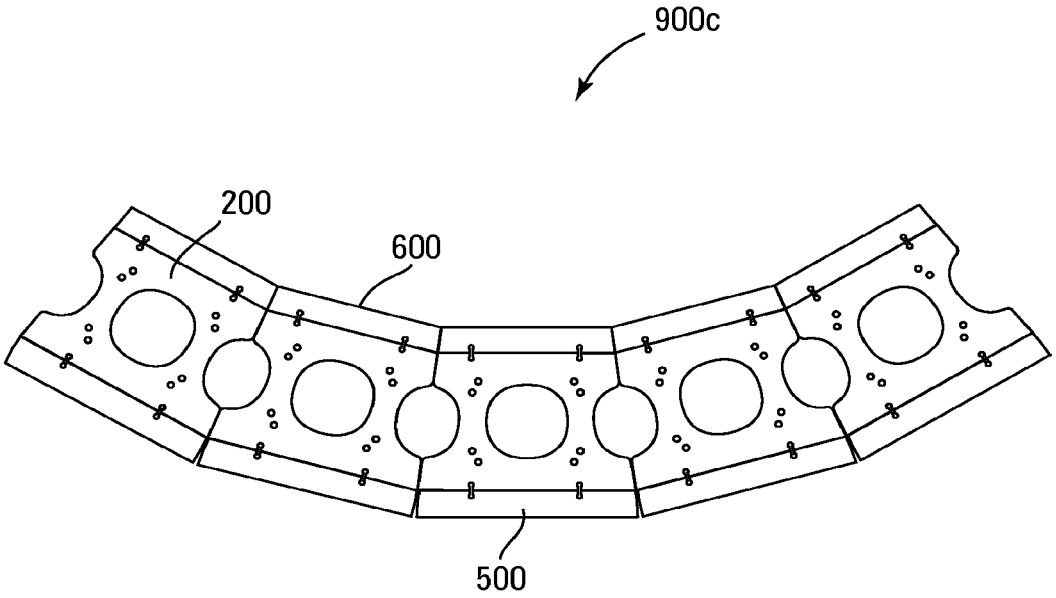

FIG. 8C illustrates a curvilinear wall 900*c* formed from blocks 200 and veneer panels 500 and 600 of the present invention. Wall 900*c* is formed with all front faces 204 of blocks 200 orientated facing outward one side of the wall and all back faces 205 orientated facing outward the opposite side of the wall with no space between the back faces which causes a consistent and constant radial curve to the wall. Veneer panels 500 may be secured to the front face 204 of the wall blocks 200 as described above with each individual veneer panel 500 being attached to an individual front face 204 of each block 200. Veneer panels 600 may be secured to the back face 205 of the wall blocks 200 as described above with each individual veneer panel 600 being attached to an individual back face 205 of each block 200.

It should be noted that the veneer panels that are connected to the wall may have varying shapes and sizes depending upon the application. For example, a veneer panel may be sized to encompass the surface area of multiple faces of adjacent blocks, either vertically adjacent, horizontally adjacent or both. Further the veneer panels may be used with random sizes to create a random aesthetically pleasing surface to a wall. Further, it should be noted that the size and shape of the blocks are not limiting either and that any size or shape may be employed depending upon the application.

Although particular embodiments have been disclosed herein in detail, this has been done for purposes of illustration only, and is not intended to be limiting with respect to the scope of the following appended claims. In particular, it is contemplated by the inventors that various substitutions, alterations, and modifications may be made to the invention without departing from the spirit and scope of the invention as defined by the claims. For instance, the choices of materials or variations in shapes are believed to be a matter of routine for a person of ordinary skill in the art with knowledge of the embodiments disclosed herein.

What is claimed is:

1. A combination comprising a wall block, a veneer, and at least one veneer connector:

the veneer having at least one connector channel for receiving a veneer connector;

the wall block comprising parallel top and bottom faces, parallel front and rear faces, and first and second side walls, the first and second side walls extending from the top face to the bottom face and from the front face to the rear face; at least one pin hole located on the top face of the block; at least one receiving pocket for receiving a pin opening onto the bottom face of the block and not extending to the top face of the block; and at least one connector channel for receiving a veneer connector that is oriented in the direction from the bottom face to the top face of the block, the at least one connector channel opening into the front or rear faces of the block;

the veneer connector comprising a first shaft and second shaft, the first shaft being attached to the second shaft by a bridge portion, the first and second shafts being parallel to each other; and the at least one veneer connector being disposed within the at least one wall block connector channel and the at least one veneer connector channel, wherein the at least one pin hole of the wall block is closed to the at least one connector channel of the wall block along the top face of the wall block and is closed to the front and rear faces of the wall block along the top face of the wall block.

2. A combination comprising a wall block, a veneer, and at least one veneer connector:

the veneer having at least one connector channel for receiving a veneer connector;

the wall block comprising parallel top and bottom faces, parallel front and rear faces, and first and second side walls, the first and second side walls extending from the top face to the bottom face and from the front face to the rear face; at least one pin hole located on the top face of the block; at least one receiving pocket for receiving a pin, the at least one receiving pocket located on the bottom face of the block and opening onto the bottom face of the block; and at least one connector channel for receiving a veneer connector that is oriented in the direction from the bottom face to the top face of the block, the at least one connector channel opening into one of the front or rear faces of the block;

the veneer connector comprising a shaft, and bifurcated horizontal prongs that extend from the shaft; and the at least one veneer connector being disposed within the at least one wall block connector channel and the at least one veneer connector channel, wherein the at least one pin hole of the wall block is closed to the at least one connector channel of the wall block along the top face of the wall block and is closed to the front and rear faces of the wall block along the top face of the wall block and wherein at least one pin hole opens into at least one receiving pocket.

3. The combination of claim 2, wherein the at least one receiving pocket located on the bottom face of the wall block opens into the front or rear face of the block.

4. A combination comprising a wall block, a veneer, and at least one veneer connector, the wall block having a top and a bottom face, a front and a rear face, at least one of the front and rear faces of the wall block having at least one connector channel for receiving a veneer connector, and at least one receiving pocket that opens onto the bottom face and opens onto one of the front or rear faces, the veneer having at least one connector channel for receiving a veneer connector, and at least one veneer connector disposed within the at least one wall block connector channel and the at least one veneer connector channel, wherein the veneer comprises top and bottom faces, front and rear faces, and first and second side surfaces, wherein an upper surface of the at least one receiving pocket is positioned above the bottom face along the front or rear face of the wall block and wherein the at least one connector channel of the wall block extends along the front or rear face of the wall block from the upper surface of the at least one receiving pocket towards the top face of the wall block and wherein the at least one veneer connector is also disposed within the at least one receiving pocket of the wall block.

5. The combination of claim 1, wherein the wall block has a height as measured from the top face to the bottom face and wherein the at least one pin hole of the wall block is closed to the at least one connector channel and is closed to the front or rear face of the wall block for at least a portion of the height of the wall block.

6. The combination of claim 5, wherein the at least one pin hole is open to the at least one connector channel and is open to the front or rear face of the wall block for a portion of the height of the wall block.

7. The combination of claim 5, wherein the at least one pin hole is closed to the at least one connector channel and is closed to the front or rear face of the wall block for the entire height of the wall block.

8. The combination of claim 1, wherein the wall block has a height as measured from the top face to the bottom face and wherein the at least one pin hole of the wall block is open to the at least one connector channel and is open to the front or rear face of the wall block for at least a portion of the height of the wall block.

9. The combination of claim 8, wherein the at least one connector channel of the wall block does not extend the entire height of the wall block.

10. The combination of claim 9, wherein the at least one connector channel of the wall block does not open onto at least one of the top or bottom faces of the block.

11. The combination of claim 8, wherein the at least one receiving pocket of the wall block opens onto the front or rear face of the wall block.

12. The combination of claim 11, wherein an upper surface of the at least one receiving pocket is positioned along the front or rear face of the wall block above the bottom face and wherein the at least one connector channel of the wall block extends along the front or rear face of the wall block from the upper surface of the at least one receiving pocket towards the top face of the wall block and wherein the at least one veneer connector is also disposed within the at least one receiving pocket.

13. The combination of claim 2, wherein the wall block has a height as measured from the top face to the bottom face and wherein the at least one pin hole of the wall block is closed to the at least one connector channel and is closed to the front or rear face of the wall block for at least a portion of the height of the wall block.

14. The combination of claim 13, wherein the at least one pin hole is open to the at least one connector channel and is open to the front or rear face of the wall block for a portion of the height of the wall block.

15. The combination of claim 13, wherein the at least one pin hole is closed to the at least one connector channel and is closed to the front or rear face of the wall block for the entire height of the wall block.

16. The combination of claim 3, wherein the wall block has a height as measured from the top face to the bottom face and wherein the at least one pin hole of the wall block is open to the at least one connector channel and is open to the front or rear face of the wall block for at least a portion of the height of the wall block.

17. The combination of claim 16, wherein the wall block has a height as measured from the top face to the bottom face and wherein the at least one connector channel of the wall block does not extend the entire height of the wall block.

18. The combination of claim 17, wherein an upper surface of the at least one receiving pocket is positioned along the front or rear face of the wall block above the bottom face and wherein the at least one connector channel of the wall block extends along the front or rear face of the wall block from the upper surface of the at least one receiving pocket towards the top face of the wall block and wherein the at least one veneer connector is also disposed within the at least one receiving pocket.

19. The combination of claim 4, wherein the wall block has a height as measured from the top face to the bottom face and wherein the at least one connector channel of the wall block does not extend the entire height of the wall block.

20. The combination of claim 5, wherein the wall block comprises at least one pin hole opening onto the top face of the wall block and wherein the at least one pin hole is open to the at least one connector channel and is open to the front or rear face of the wall block for at least a portion of the height of the wall block.

* * * * *